US010584943B2

(12) United States Patent
Armellino, Jr.

(10) Patent No.: US 10,584,943 B2
(45) Date of Patent: Mar. 10, 2020

(54) FREE-FLOATING BALLISTIC SHIELD HANDLE SYSTEM

(71) Applicant: Baker Ballistics, LLC, Lititz, PA (US)

(72) Inventor: Richard A. Armellino, Jr., Lancaster, PA (US)

(73) Assignee: BAKER BALLISTICS, LLC, Lititz, PA (US)

( * ) Notice: Subject to any disclaimer, the term of this patent is extended or adjusted under 35 U.S.C. 154(b) by 0 days.

(21) Appl. No.: 15/786,745

(22) Filed: Oct. 18, 2017

(65) Prior Publication Data

US 2018/0202771 A1 Jul. 19, 2018

Related U.S. Application Data

(60) Provisional application No. 62/446,679, filed on Jan. 16, 2017.

(51) Int. Cl.
*F41H 5/08* (2006.01)

(52) U.S. Cl.
CPC ..... *F41H 5/08* (2013.01)

(58) Field of Classification Search
CPC . F41H 5/08; F41H 5/013; F41H 5/026; F41H 5/24; F41H 7/04
USPC ..... 89/36.07, 36.01, 36.02, 36.08, 36.09
See application file for complete search history.

(56) References Cited

U.S. PATENT DOCUMENTS 3,745,938 A * 7/1973 Hathaway ..... F41H 5/08 109/49.5
3,762,345 A * 10/1973 Sgariglia, Jr. ..... A45C 3/02 109/22
3,814,016 A * 6/1974 Leach ..... F42D 5/05 102/303
4,546,863 A * 10/1985 Kaufman ..... A45C 3/02 109/49.5
4,608,717 A * 9/1986 Dunbavand ..... B32B 9/04 2/2.5
4,782,735 A * 11/1988 Mui ..... F41H 5/08 102/303
5,377,577 A * 1/1995 Bounkong ..... F41H 5/08 2/2.5
6,000,347 A * 12/1999 Madden, Jr. ..... A45C 9/00 109/22
6,161,462 A * 12/2000 Michaelson ..... F41H 5/06 102/303
6,279,449 B1 * 8/2001 Ladika ..... F41H 5/007 89/36.02
6,595,101 B2 * 7/2003 Baker ..... F41H 5/08 89/36.05
6,691,601 B2 * 2/2004 Cohen ..... F41H 5/06 109/49.5
6,807,890 B1 * 10/2004 Fuqua ..... F41H 5/08 89/36.02

(Continued)

*Primary Examiner* — Michael D David
(74) *Attorney, Agent, or Firm* — Matthew P. Frederick; Cheryl L. Gastineau; Reed Smith LLP

(57) ABSTRACT

A system includes a ballistic shield having a strike face and an opposing safe face. A thickness of the ballistic shield extends from the strike face to the safe face. The system can further include a base plate having a shield side and an opposing body side. The base plate can be connected to the ballistic shield. The base plate is not directly connected to either the strike face or the safe face by a fastener that traverses the thickness of the ballistic shield.

11 Claims, 24 Drawing Sheets

(56) References Cited

U.S. PATENT DOCUMENTS 7,520,206 B2 * 4/2009 Baker ..... F41H 5/08 89/36.05
7,716,748 B2 * 5/2010 Dovner ..... F41C 33/0209 2/2.5
8,015,910 B1 * 9/2011 Fuqua ..... F41H 5/14 89/36.01
8,250,963 B2 * 8/2012 Fuqua ..... B60R 3/005 182/129
8,356,540 B2 * 1/2013 Priebe ..... F41H 5/08 89/36.01
8,584,571 B2 * 11/2013 Armellino, Jr. ..... F41H 5/08 89/36.01
8,640,593 B2 * 2/2014 Hazan ..... F41H 5/007 89/36.01
9,010,230 B2 * 4/2015 Peters ..... F41H 5/24 89/36.02
2012/0167752 A1 * 7/2012 Buckner ..... B42F 9/002 89/36.02
2012/0180628 A1 * 7/2012 Imblum ..... F41H 5/08 89/36.02
2012/0180636 A1 * 7/2012 Seuk ..... F41H 5/08 89/36.07
2013/0098234 A1 * 4/2013 Armellino, Jr. ..... F41H 5/08 89/36.05
2013/0205983 A1 * 8/2013 Martin ..... F41H 5/013 89/36.07
2014/0208932 A1 * 7/2014 Lee ..... F41H 5/013 89/36.09
2014/0224109 A1 * 8/2014 Chandler ..... F41H 5/08 89/36.07
2014/0233235 A1 * 8/2014 Micarelli ..... F41H 5/08 362/253
2014/0238225 A1 * 8/2014 Mickiewicz ..... F41H 5/08 89/36.07
2014/0251122 A1 * 9/2014 Adams ..... F41H 5/08 89/36.07

* cited by examiner

FREE-FLOATING BALLISTIC SHIELD HANDLE SYSTEM

FIELD OF THE PRESENTLY DISCLOSED TECHNOLOGY

The presently disclosed technology relates generally to a ballistic shield mounting system that can include a ballistic shield and a base plate, wherein the base plate is not directly connected to the ballistic shield by a fastener that traverses the thickness of the ballistic shield.

Ballistic shields are protective armor panels or devices designed to absorb or deflect bullets, arrows, or other dangerous projectiles fired at the person carrying the ballistic shield, thereby preventing death or serious injury. Typically, ballistic shields are carried by the person.

Modern lightweight composite-based ballistic shields derive much of their anti-ballistic protective properties by utilization of combinations of, or proprietary use of, various types of high-strength fibers, ceramics, epoxy, and/or plastic based materials. These high-strength materials typically are mechanically or chemically affixed together, often in layers, for example via lamination, which provides additional ballistic strength and an improved weight or density to performance ratio. The basic principle is based upon the impacting projectiles' ability to break the molecular bond(s) of the individual layers, and/or the mechanical bond(s) between multiple layers of the high-strength materials located within the composite armor panel. Separation forces that the projectile(s) impart on the materials and layers, including delamination of the layers, progressively absorbs and reduces energy from the impacting projectile, allowing internal sections of the composite panel to move laterally backwards away from the strike face of the armor, greatly improving the armor's ability to capture the projectile within the composite armor panel and without letting the projectile traverse the entire thickness of the panel.

The finished composite ballistic shield may have a range of numbers of layers and thicknesses of both the individual layers, and the total finished thickness of the armor panel. The thickness of the finished composite ballistic shield may depend upon the ballistic capability, the type of raw ballistic material being used, or combinations (hybrids) using multiple layers or plies of different materials within the same armor panel. Generally, total composite thicknesses range from 5 mm to 20 mm thick, and vary from 10 layers to 200 layers. Some materials used in the construction of armored shields, for example para-aramid fiber such as Kevlar®, are woven fiber reinforced epoxy or plastics. Other materials, for example polyethylene plastic film, are comprised of thin hair-like fibers oriented in a specific predetermined pattern and held in position or sandwiched between two outer layers of thin plastic film, for example similar to plastic wrap, and often heated and pressed under extreme pressure to bond the layers and strengthen the molecular bonds between layers. This adds rigidity to the compressed armor panel, increasing ballistic performance at comparative density levels as the original non-compressed armor panel.

In certain examples, when the layers of a composite armor are prevented from separating and/or delamination, it becomes less effective at stopping projectiles, in some cases causing the impact restricted region from failing to capture a projectile, i.e. allowing the projectile to traverse the entire thickness of the shield. One such typical area of weakness in a shield may be the edges of the shield.

Edges of a composite armor shield may be weak due to a lack of available material to absorb the energy of an impacting projectile. Impacting projectiles generally require a radius of approximately 3 inches surrounding the point of impact to provide enough available ballistic material to efficiently absorb the energy and capture the projectile. When the distance from the point of impact to an edge, for example, is less than 3 inches, the chances of complete penetration are significantly increased the closer the projectile strikes in proximity to the armor's edge.

Additionally, through-bolts inserted anywhere, including near the edges, may reduce the composite armor's ability to absorb energy via delamination in that region and further increase the likelihood of complete penetration. In certain embodiments, this may be because the through-bolts "pinch" the layers, preventing their delamination. In some testing known in the field, test projectiles that completely penetrate the armor panel within 1 or 2 inches from the armor's edges do not typically indicate a failure of the overall shield's design or ballistic capability, as failures that occur near the edges are deemed "unfair hits" during government sanctioned ballistic panel testing. Similarly, the chances of failure are increased when test projectiles impact an armor panel within 1 or 2 inches from a through-bolt or other hole or accessory that traverses the thickness of a composite shield.

A common characteristic of portable composite armor designed to be wheeled or carried, such as a mobile protective ballistic shield, is the necessity of affixing hardware to the interior, i.e. non-perimeter regions of shield—in other words, away from the edges of the shield. The hardware is typically affixed to the safe face of the shield, or the face of the shield facing the person that the armor is protecting. Examples of the hardware include, for example, but not limited to: handles, windows, frames, mounting plates, and the like. In the case of hardware that traverses the thickness of the shield, such as a bolt or a window frame, the hardware is also affixed to the strike face of the shield.

Whenever a bolt or other type of hardware completely traverses the thickness of the composite armor panel in order to securely fasten hardware to either the outside (strike face) or inside (safe face) surface of the armor, the composite armor material(s) may be pinched and/or restricted in their ability to expand, deform and/or delaminate when struck by a projectile. This restriction of the composite armor's ability to internally delaminate, expand, separate, or deform may reduce the ballistic strength of the composite armor in the regions of the armor that are so restricted due to the proximity of the hardware traversing its thickness.

Hardware that traverses the thickness of the shield may also inhibit thermal expansion of the shield, especially in cases where the coefficient of thermal expansion is different for the shield and hardware.

Thermal expansion and contraction can damage the armor composite panel in a variety of ways. For example, hardware such as an edge molding can loosen and detach. Through-bolt holes can elongate and affect the security of the attached hardware. If attachment hardware restricts the thermal expansion and contraction of the composite armor panel itself during temperature extremes, the composite armor panel itself can warp and change in shape, exceeding design parameters.

Projectiles that impact a shield in close proximity to hardware traversing its thickness may be more likely to completely penetrate the armor due to "edge weakness"—or weakness in the armor near the edges of hardware traversing its thickness (or the edge of the shield itself). For example, the area of the armor at or near circular holes cut or drilled completely through the armor are in effect round edges that create a bolt hole that traverses the thickness of the armor, which may possess the same deficiency in capturing projectiles as the outside perimeter edges of the entirety of the ballistic shield.

SUMMARY

In one embodiment, the presently disclosed technology is directed to a ballistic shield mounting system including a ballistic shield having a strike face and a safe face. The shield can also include a base plate having a shield side and a body side. In one embodiment, the base plate is not directly connected to the safe face by a fastener that traverses the thickness of the ballistic shield.

DESCRIPTION OF THE FIGURES

The foregoing summary, as well as the following detailed description, will be better understood when read in conjunction with the appended drawings. For the purpose of illustrating the presently disclosed technology, there are shown in the drawings various illustrative embodiments. It should be understood, however, that the presently disclosed technology is not limited to the precise arrangements and instrumentalities shown. In the drawings.

DETAILED DESCRIPTION

Figure 1:
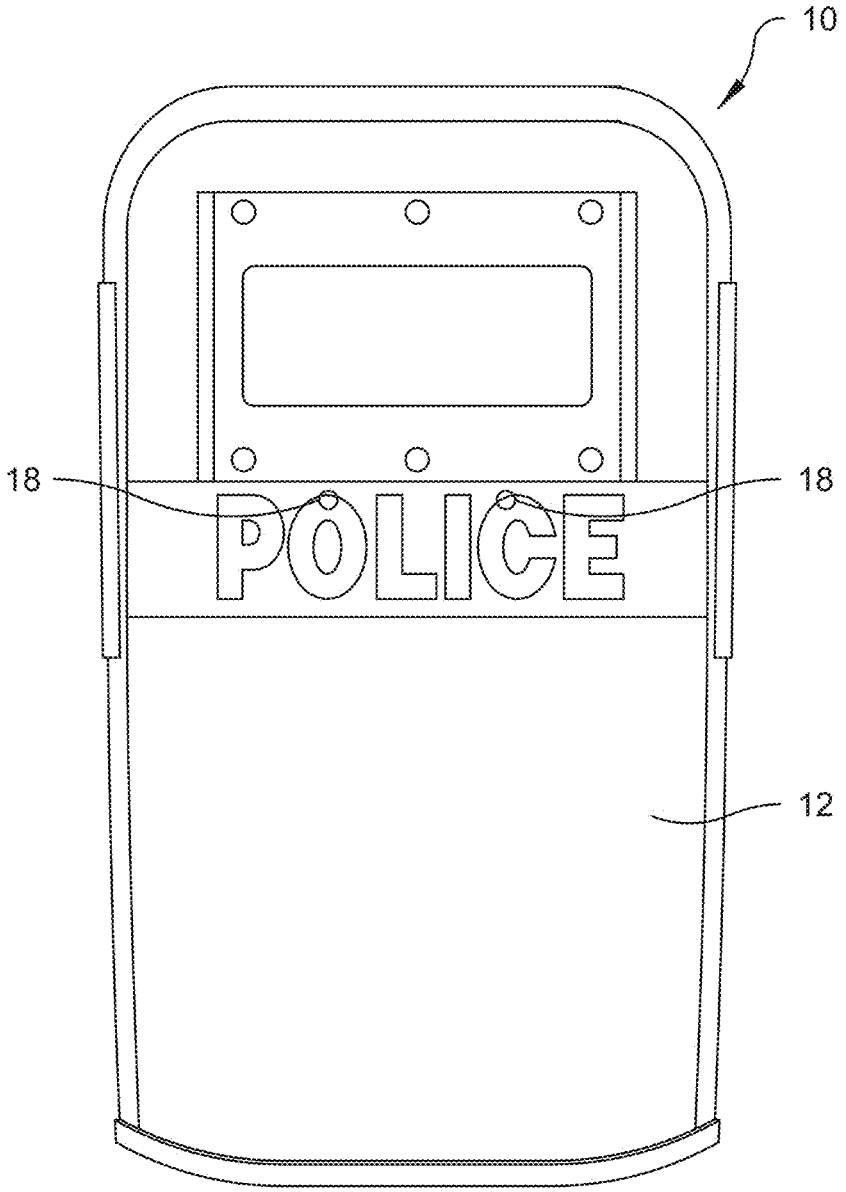
Fig. 1 (Prior Art)
FIG. 1 is a front view of a shield according to the prior art.
Figure 2:
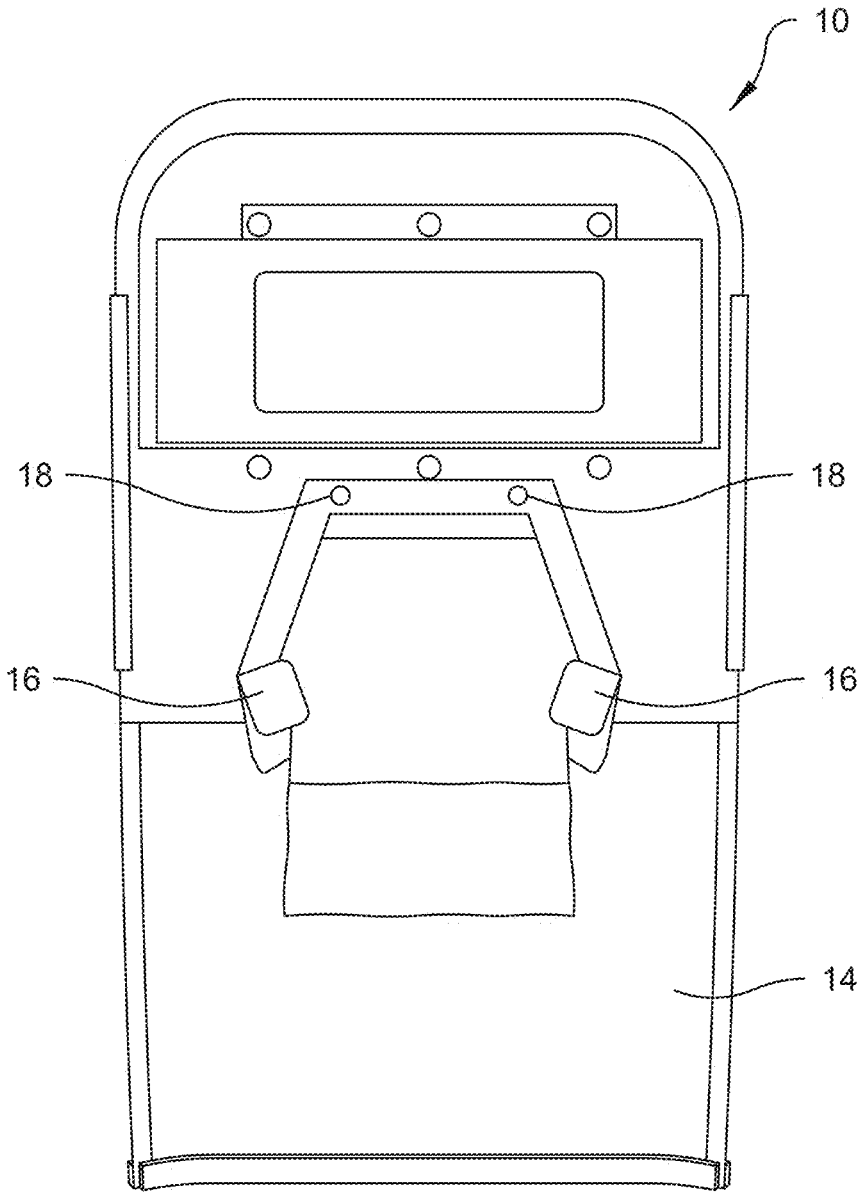
Fig. 2 (Prior Art)
FIG. 2 is a rear view of the shield of FIG. 1.

Numbers in the present disclosure are rounded to the nearest significant figure using conventional rounding techniques. Ranges of numbers contained herein are understood to contain the numbers on the upper and lower limits, unless otherwise indicated. For instance, a range "from 1 to 10" is understood to include a range including the number "1," and up to and including the number "10." Numbers herein are understood to be modified by the word "about" unless otherwise indicated. Unless specifically set forth herein, the terms "a," "an" and "the" are not limited to one element but instead should be read as meaning "at least one."

A ballistic shield 10 can include a face or front panel 12 that faces towards the projectile and away from the person being protected by the shield. This face is referred to herein as the strike face. A ballistic shield 10 can also have a face or rear panel 14 that faces towards the person being protected by the shield, referred to herein as the safe face.

In the prior art, the shield 10 is held, for example, by a person grasping at least one handle 16 mounted to the safe face 12. The handle 16 is mounted by a fastener 18 that traverses the entire thickness of the ballistic shield 10. Examples of such fasteners include bolts, screws, and rivets. In these prior art shields 10, holes are made, for example by drilling, in the ballistic shield 10 that match the hole pattern of the handle 16. Fasteners 18, e.g. bolts, are threaded through the holes in the handle 16 and the corresponding hole in the ballistic shield 10 and secured, e.g. with a nut 20, or some other threaded receiver for the bolt.

In certain embodiments of the presently disclosed technology, no holes are made in the ballistic shield 110. In other embodiments, holes are only made in the ballistic shield 110 near an edge. In still further embodiments, holes are only made in the ballistic shield 110 from the edge to within approximately 1 inch away from the edge, or from the edge to within approximately 2 inches away from the edge, or from the edge to within approximately 3 inches away from the edge. In certain embodiments, fasteners are only placed in these holes near an edge.

In some embodiments of the presently disclosed technology, one or more handles 116 and other accessories of the ballistic shield 110 are not directly connected to the safe face 114 of the ballistic shield 110 by a fastener that traverses the thickness of the ballistic shield 110. Other embodiments of the presently disclosed technology can include at least one base plate 130 that is not directly connected to the safe face 114 of the ballistic shield 110 by a fastener that traverses the thickness of the ballistic shield 110. The base plate 130 can include a first or body side 130*a* that faces towards the person or article being protected by the shield 110, and an opposing second or shield side 130*b* that faces towards the ballistic shield 110. The base plate 130 can include a plurality of spaced-apart openings. At least some of the openings can be sized, shaped and/or configured to receive one or more fasteners, while other openings of the base plate 130 can have different configurations or shapes (e.g., oval). At least some of the openings can be configured to increase the force absorbing characteristics of the base plate 130 and/or allow ballistic shield accessories to be easily attached thereto. The base plate 130 can be square in shape, such that each edge thereof is at least generally the same length.

In certain embodiments, ballistic shield accessories can be attached to the base plate 130 instead of being directly connected to the safe face 114 of the ballistic shield 110. In some embodiments, ballistic shield accessories are attached to the base plate 130 by a fastener that traverses the thickness of the base plate 130. In this manner, the base plate 130 and accessories attached to the base plate 130 may be considered "free floating" with respect to the ballistic shield 110, in that they are not directly connected to the safe face 114 of the ballistic shield 110 by a fastener that traverses the thickness of the ballistic shield 110.

In certain embodiments, the base plate 130 is made out of any rigid or generally rigid material. In some embodiments, the base plate 130 can provide for mechanical and/or chemical adhesion to the safe face 114 of the shield 130. In further embodiments, the base plate 130 provides structural support allowing the lifting forces from the handle 116 attached to the base plate 130 to be transferred from the base plate 130 to the ballistic shield 110. In certain embodiments, the base plate 130 is made from plastic or metal. In some embodiments, the base plate 130 can be from ⅛ inch thick to 4 inches thick, in other embodiments from ½ inch thick to 3 inches thick, and in still further embodiments, the base plate may be approximately ¾ inch thick, depending upon the desired level of threats the shield is designed to defeat, and/or the type of armor material(s) are being utilized in the construction.

In some embodiments, the base plate 130 can be from 3 inches to 20 inches both wide and tall, and in still further embodiments, the base plate 130 can be approximately 6 inches wide and tall, depending upon the weight of the shield and/or the types of accessories and carrying hardware intended to be affixed to the base plate.

In certain embodiments, shield accessories can include handles 116, weight-carrying attachments, adapters, stand-off pads and devices, hand holds, arm holds, lighting accessories, ammunition pouches, communications gear, camera accessories, suspension equipment and quick-release devices and the like. The accessories may be attached to the base plate 130 using, for example, a fastener such as a bolt, screw or rivet, quick release device, or adhesives or hook and loop material. In some embodiments, an adapter can receive other shield accessories that are not mounted directly to the base plate 130.

In certain embodiments, the shield side 130*b* of the base plate 130 is held against and/or in contact with the safe side 114 of the ballistic shield 100 by a force acting on the base plate 130. In some embodiments, this force is a spring tension, meaning that the base plate 130 is held in place by a force that is beyond its equilibrium point. With enough force acting against the base plate 130 from the shield side 130*b*, the base plate 130 may separate from the ballistic shield 100, or move with respect to the ballistic shield 110. When the force dissipates, the spring tension will once again move the base plate 130 back to its original position and/or into contact with the safe face 114 of the ballistic shield 110, or allow the base plate 130 to follow the ballistic shield 110 as it moves.

In certain embodiments, the spring tension is provided by a spring tension device 140. In some embodiments, the spring tension device is selected from the group consisting of a spring clip, a spring, a strap, webbing, fabric, and combinations of any thereof. In embodiments held by a spring, the spring may act directly on the body side 130*a* of the base plate 130. The spring may be, for example, a coil spring, or it may be any spring tension device that exhibits spring tension, for example a structure that deflects elastically under force then returns to its original or nearly original shape.

Figure 18:
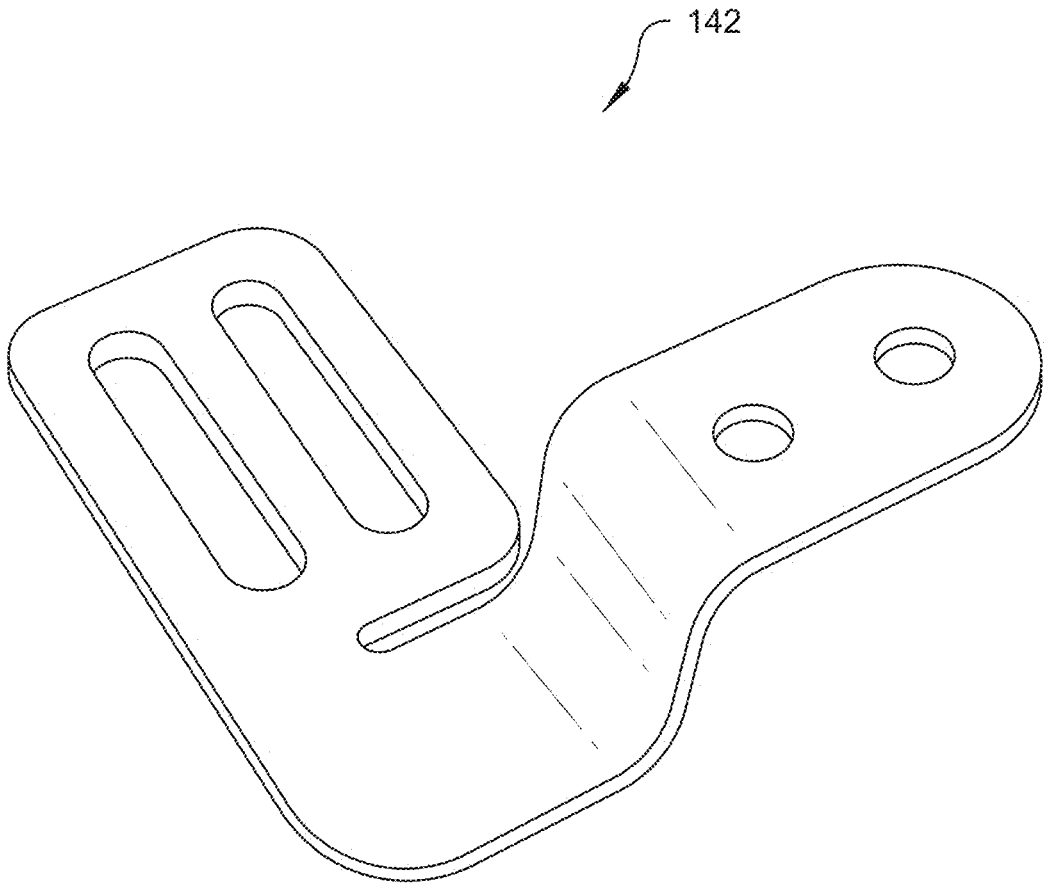
FIG. 18 is a perspective view of a portion of the system shown in FIGS. 10-12.

In certain embodiments, the base plate 130 is held in place or generally prevented from moving by at least one spring clip 142 (sometimes referred to herein as "base plate spring clip"). One example of a base plate spring clip 142 is shown in FIG. 18. In some embodiments, a base portion 144 of each spring clip 142 is retained against the safe side 114 of the ballistic shield 110. In other embodiments, another portion 146 of each spring clip 142 can contact the base plate 130 directly.

One portion of each spring clip 142 can be shaped in such a way as to deflect elastically under force and provide spring tension on the base plate 130. In certain embodiments, upon application of force, each spring clip 142 should spring back to its preset or nearly original position. The preset position may depend upon the temperature of each spring clip 142. In one embodiment, the spring clips 142 remain under tension to keep the base plate 130 in contact with the safe face 114 of the shield 110. In some embodiments, the spring clips 142 remain under tension to keep the base plate 130 in contact with the safe face 114 of the shield 100 during the impact of a projectile on the strike face of the shield 100. In still further embodiments, the spring clips 142 remain under tension during the impact of a projectile so that the base plate 130 continues to apply lifting force to the shield 110. The springing action of each spring clip 142 may serve several functions, such as to keep the base plate 130 in contact with or generally motionless with respect to the safe face 114 of the shield 110, to prevent damage to the through-bolt holes, to prevent the shield 110 from warping in temperature extremes, and to prevent webbing or straps as described below from going slack, or becoming over-tightened during temperature changes.

In certain embodiments, the spring clips 142 are made from metal. In other embodiments, the spring clips 142 are made from steel. In still further embodiments, the spring clips 142 are made from heat-treated steel. In other embodiments, the spring clips 142 are made from spring steel.

In still other embodiments, the spring tension device 140 further include at least one strap 150, webbing, fabric, and combinations of any thereof. Each strap 150, webbing, or fabric can attach to the ballistic shield 100, and at least some portion contacts the base plate 130 to exert the spring tension. Each strap 150, webbing, or fabric can be pulled taut, such that it will only deflect under a force from the base plate 130, providing the spring tension on the base plate 130. In certain embodiments, the strap 150, webbing, or fabric can be under from approximately 100 lbs to 200 lbs of tension.

In some embodiments, each strap 150, webbing, or fabric is made of a strong material. The material may be strong enough such that the strap 150, webbing, or fabric does not break when a projectile strikes the strike face of the shield 110. In other embodiments, the strap 150, webbing, or fabric has a high tensile strength and a minimal amount of stretch, and generally does not creep, elongate or stretch under the constant tension applied by any embodiment herein, or by any forces applied to the base plate 130 by the user of the shield 110, or other manipulations transferred through base plate accessories. In further embodiments, each strap 150, webbing, or fabric does not break during forces acting on the base plate 130 and/or each strap 150, webbing, or fabric directly from a projectile striking the strike face of the shield 110 and forcing the safe face 114 of the shield 110 against the base plate 130 and/or each strap 150, webbing, or fabric. In still further embodiments, each strap 150, webbing, or fabric must not break or elongate when used with one or more spring clips 142 as described herein, when each of the spring clips 142 has reached their maximum open position.

In some embodiments, each strap 150, webbing, or fabric is made out of a para-aramid fiber such as Kevlar®. In other embodiments, each strap 150, webbing, or fabric is made out of nylon, polyester, a reinforced plastic, cotton, or wool.

Figure 5:
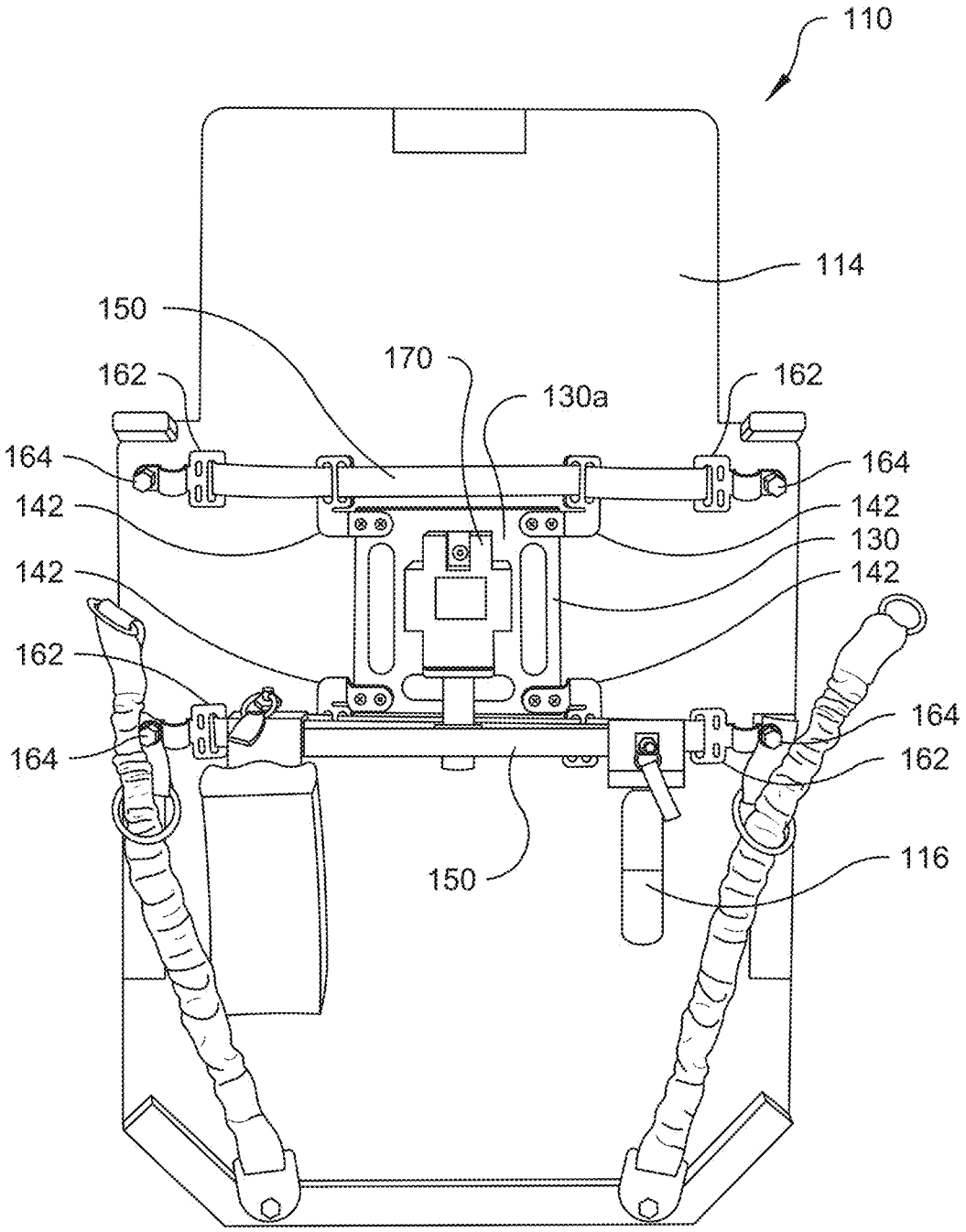
FIG. 5 is a rear view of at least a portion of a ballistic shield system according to one embodiment of the present disclosure.

Certain embodiments can include both at least one spring clip 142 and at least one strap 150, such as in FIG. 5. In other embodiments, a least two spaced-apart spring clips 142 will be located opposite from each other on the safe side 114 of the shield 110. In other words, the base plate 130 can be located between at least a portion of at least two (or four, for example) spring clips 142 and the safe side 114 of the ballistic shield 110. At least one strap 150 can interface with and/or extend through at least a portion of each of the at least two spring clips 142. In some embodiments, each strap 150 is fixably attached to at least one or each of the spring clips 142, for example by sewing, tying, looping, threading, crimping, ultrasonic welding, or by fasteners, such as bolts, screws, rivets, or some other means. In other embodiments, each spring clip 142 can include a buckle or a series of openings, and the strap 150 can be threaded through the buckle. Each strap 150 can be taut between the at least two spring clips 142, and in this configuration each strap 150 contact at least a portion of the body side 130*a* of the base plate 130 and can apply a spring tension to the base plate 130, forcing the shield side of the base plate 130 against the safe face 114 of the ballistic shield 110. In some embodiments, at least one spring clip 142 is used. In one embodiment, the strap 150 is connected at one end of the shield 110 to a spring clip 142, and at the other end of the shield 110 to the shield 110 itself, with the strap 150 interfacing with the spring clip 142 and base plate 130 as described above.

Figure 16:
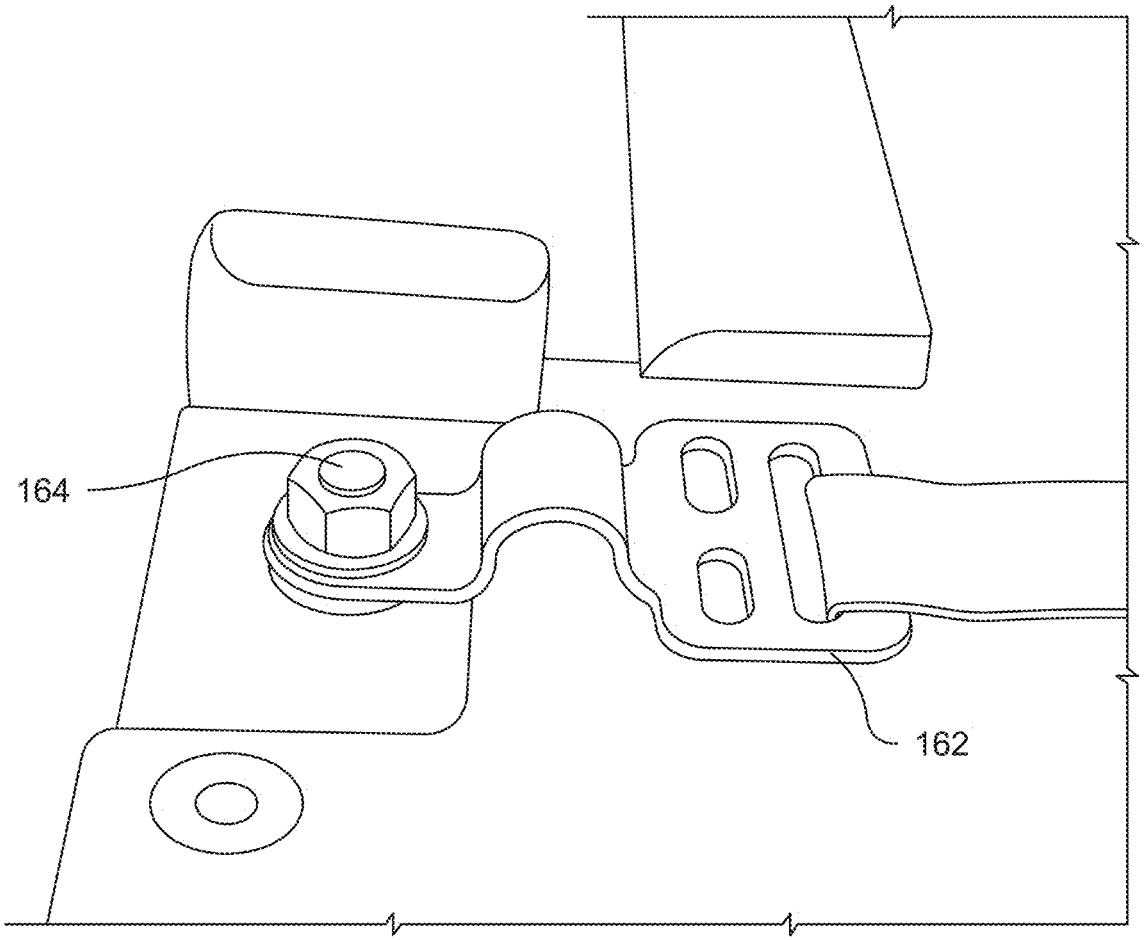
FIG. 16 is a magnified view of at least a portion of the system shown in FIG. 10.
Figure 17:
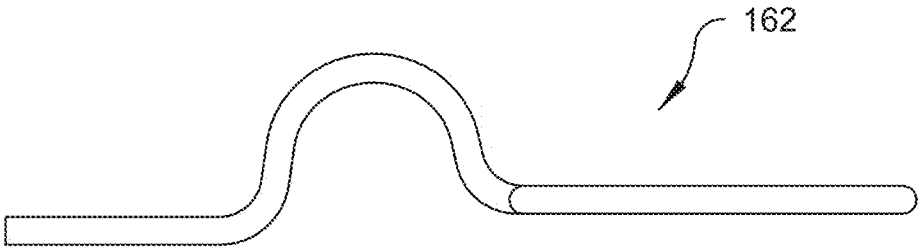
FIG. 17 is a side view of a portion of the system shown in FIG. 16.

In some embodiments, one or more spring clips 162 are mounted near an outer or exterior edge of the ballistic shield 110, hereinafter referred to as edge spring clips. One example of a edge spring clip 162 is shown in FIGS. 16 and 17. The edge spring clips 162 can have a different size, shape and/or configuration than the base plate spring clips 142, or all of the spring clips can be the same. In further embodiments, the edge spring clips 162 are mounted from the edge to within 1 inch away from the edge, or from the edge to within 2 inches away from the edge, or from the edge to within 3 inches away from the edge. In certain embodiments, the edge spring clips 162 are mounted to the ballistic shield 110 by at least one fastener 164 that traverses the thickness of the ballistic shield 110. In some embodiments, the holes for the fasteners 164 are only made in the ballistic shield 110 near an edge. In still further embodiments, preformed holes are only made in the ballistic shield 110 from the edge to within 1 inch away from the edge, or from the edge to within 2 inches away from the edge, or from the edge to within 3 inches away from the edge. In still further embodiments, the edge spring clips 162 are mounted on the safe face 114 of the ballistic shield 110.

In certain embodiments, each strap 150 interfaces with, contact, and/or extend through at least a portion of the base plate 130, but is not directly attached to the base plate 130. In some embodiments, each strap 150 is fixably attached to the base plate 130, for example by sewing, tying, crimping, ultrasonic welding, fasteners, for example bolts, screws, rivets, or some other means.

Figure 6:
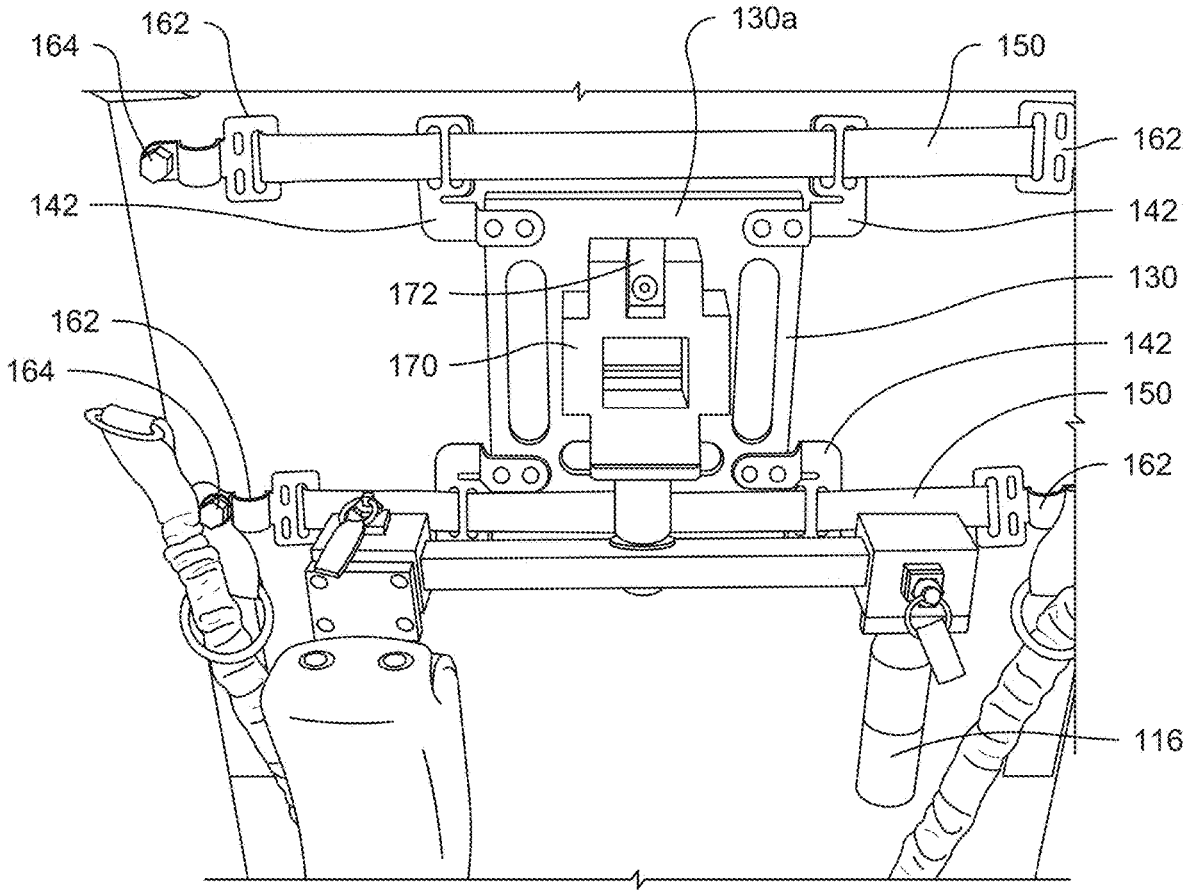
FIG. 6 is a magnified view of a portion of the system of FIG. 5.
Figure 7:
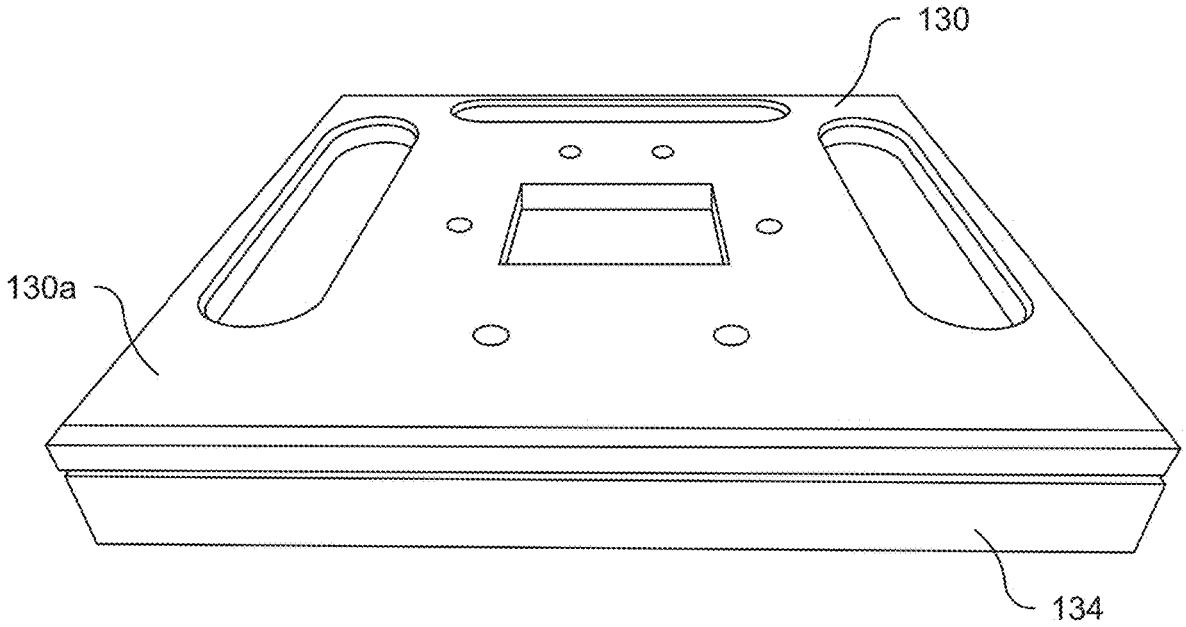
FIG. 7 is a magnified perspective view of a portion of the system of FIG. 5.

In other embodiments, each strap 150 is moveably attached to the base plate 130. In certain embodiments, at least one of the spring clips 142 can be mounted directly to the base plate 130, such that each strap 150 interfaces with, contacts and/or extend through at least a portion of the at least one spring clip 142. In certain embodiments, each spring clip 142 can include a buckle and the strap 150 is threaded through the buckle as shown in FIG. 6. In certain embodiments, one strap 150 connects one spring clip 162 at or near an edge of the shield 110 to at least one spring clip 142 at or near an edge of the base plate 130, wherein the strap 150 can be taut. In other embodiments, one strap 150 can connect to one spring clip 142, and connect at the opposite side of the shield 110 with a second spring clip 142 proximate an opposing edge of the shield 110. The strap 150 can be taut between the spring clips 142, and in this configuration the strap 150 can apply a spring tension to the base plate 130 through the spring clips 142, forcing the shield side 130*b* of the base plate 130 against or at least closer to the safe face 114 of the ballistic shield 110.

Figure 24:
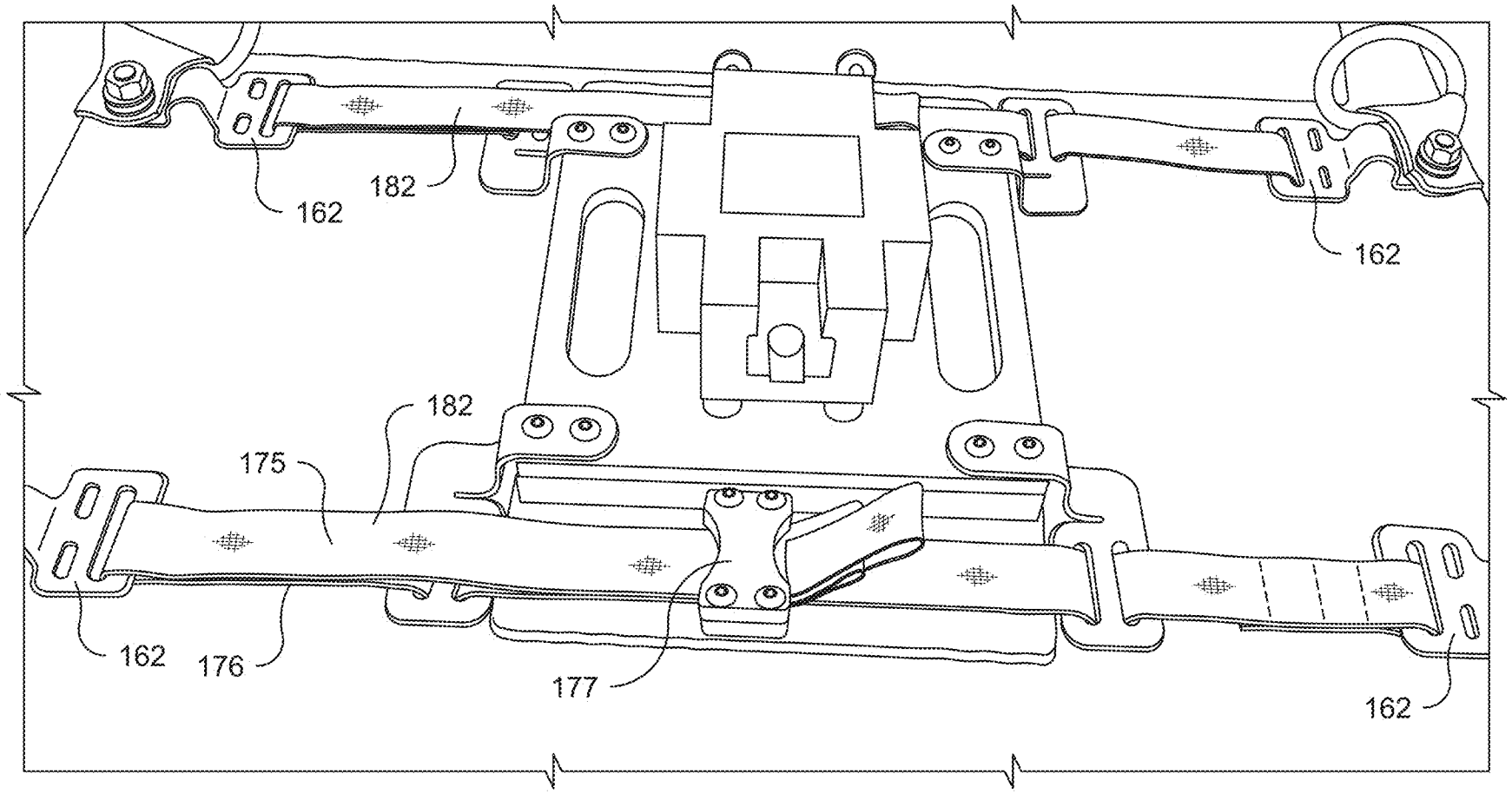
FIG. 24 is a magnified perspective view of a portion of the system shown in FIG. 26.

In certain embodiments, at least one strap 182 is routed through a buckle or other opening in a spring clip 162, wherein the strap can be folded or doubled over on itself, such that a first end or portion 175 of the strap runs parallel to a second end or portion 176 of the strap across the shield as seen in FIG. 24. In these embodiments, at least one of the first end 175 or the second end 176 can be routed through at least one slip-joint clamp 177. The slip-joint clamp 177 exerts a force on the strap so that the strap 182 resists sliding through the slip-joint clamp 177 unless some threshold force is applied to the strap 182. For example, if a projectile with sufficient energy were to impact the strike face of the shield, and the impact causes a force on the strap 182 that exceeds a threshold force, the strap may slide through the slip-joint clamp 177 by some amount or a predetermined distance in order to help absorb the impact from the projectile.

Figure 25:
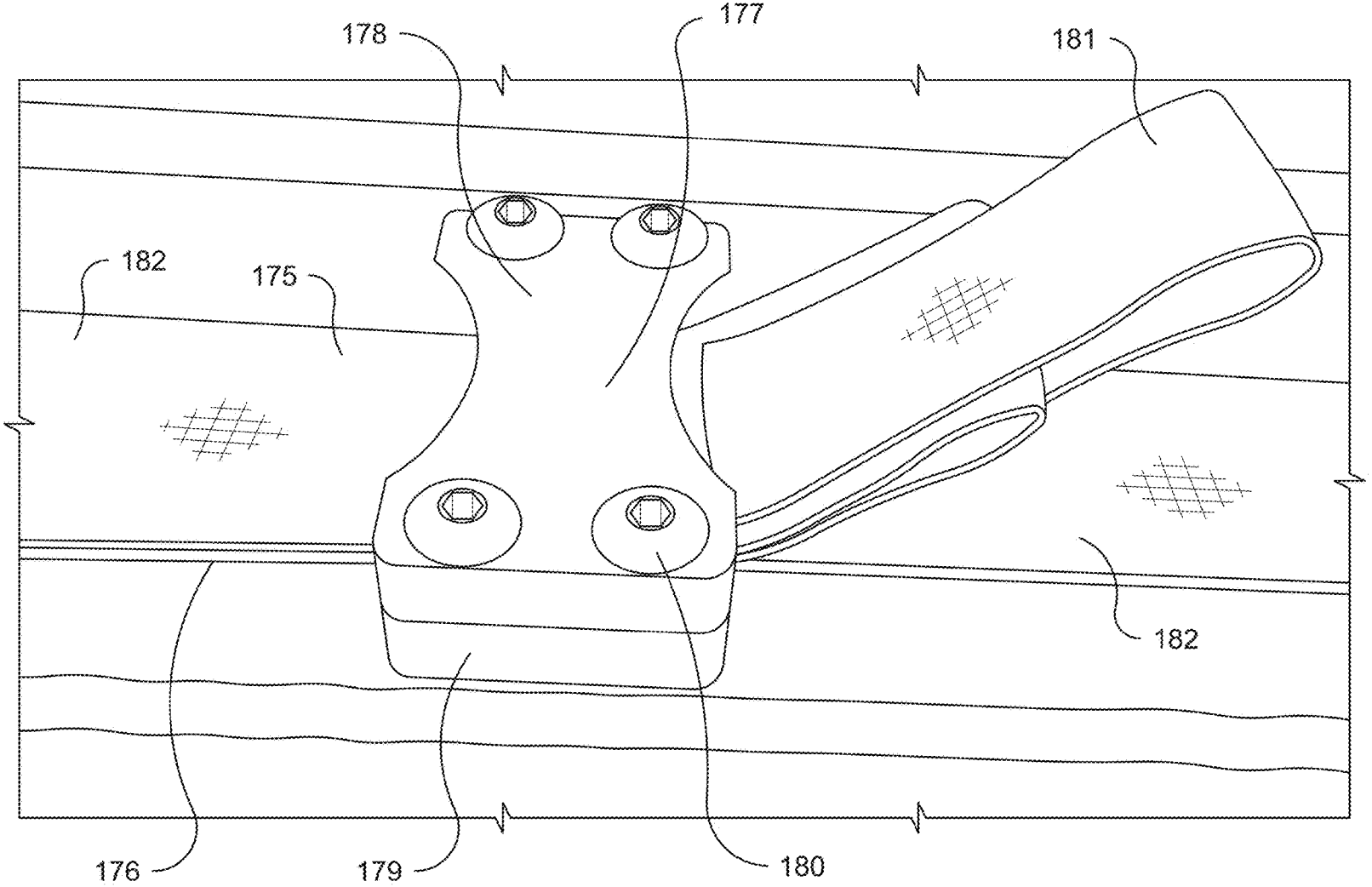
FIG. 25 is a magnified perspective view of a portion of the system shown in FIG. 24 and FIG. 26.

As explained above, in certain embodiments, at least one of the first end 175 and the second end 176 of the strap can be routed through the slip-joint clamp 177. In another embodiment, both the first end 175 and the second end 176 of the strap can be routed through the slip-joint clamp 177 as shown in FIG. 25. In this embodiment, the slip-joint clamp 177 can press the first end 175 and the second end 176 of the strap together, creating the force on the strap. In another embodiment, the slip-joint clamp 177 can have another, intermediatepiece that separates and/or is between the first end 175 from the second end 176 of the strap, and the first end 175 and the second end 176 of the strap are pressed against that piece instead of being pressed against one another.

In one embodiment, such as the one shown in FIG. 25, the slip-joint clamp 177 can include a first side 178 and an opposing second side 179. The first side 178 and the second side 179 can be made of any rigid material, for example, metal, carbon fiber, plastic, wood, or a composite material. In these embodiments, the strap 182 or straps is routed in between the first side 178 and the second side 179 of the slip-joint clamp 177. In various embodiments, the first side 178 and the second side 179 can be held together with one or more spaced-apart fasteners 180, including but not limited to bolts, screws, rivets, clamps, springs, or other means. In the embodiment shown in FIG. 25, the first side 178 and the second side 179 are held together with screws. In these embodiments, in addition to holding the first side 178 and the second side 179 together, the fastener(s) 180 also exert the force against the first side 178 and the second side 179, which in turn exert a force on the first end 175 and the second end 176 of the strap that is routed through the slip-joint clamp 177. The fasteners 180 can be selectively tightened until the desired force is applied on the first end 175 and the second end 176 of the strap, such that the strap does not slide through the slip-joint clamp 177 until the threshold force is applied.

In certain embodiments, the threshold force can be measured by pulling on a strap 182 with tension gauge, for example. In certain embodiments, the slip-joint clamp 177 is attached to one of the safe side of the shield or the base plate. In other embodiments, the slip-joint clamp is not attached to the shield or base plate, and is only attached to the strap.

Figure 26:
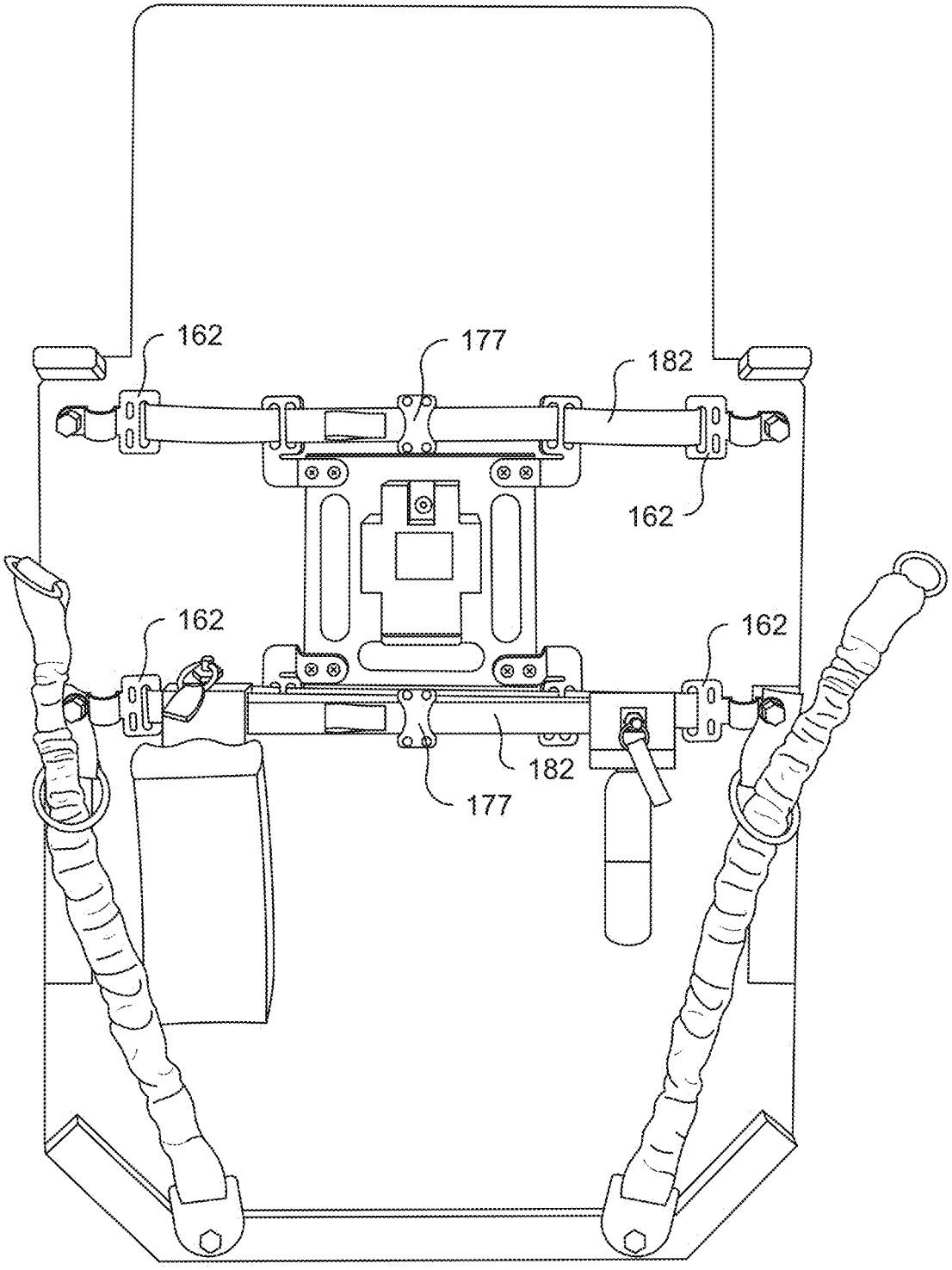
FIG. 26 is a rear view of at least a portion of a ballistic shield system according to one embodiment of the present disclosure.

In still a further embodiment, a blocking mechanism is attached to the end of either the first end 175 or the second end 176 of the strap to prevent the strap from passing entirely through the slip-joint clamp 177. In certain embodiments, the blocking mechanism can include a length of strap 182 that is folded back on and attached to itself, forming a loop 181 as shown in FIG. 25, or other formation that is thicker than the thickness of the strap. In certain embodiments, one goal of the blocking mechanism is to prevent a strap 182 from passing completely through the slip-joint clamp 177, which may cause the base plate to separate from the shield, which may expose the user to other projectiles. The strap 182 may be attached to itself to form the loop 181 by sewing, glue, ultrasonic welding, or using a fastener, including but not limited to bolts, screws, rivets, clamps or springs. In certain embodiments such as the one shown in FIG. 26, slip-joint clamps 177 are included on both straps 182.

In other embodiments, other types of slip-joint clamps may be employed, for example, clips, springs, clamps, buckles, and the like, such that the strap 182 is prevented from sliding through such slip-joint clamp until a threshold force is applied to the strap 182.

In an alternative embodiment, at least one of the spring clips, edge spring clips, and base plate spring clips are omitted or not employed, and the at least one strap 150, webbing, fabric, and combinations of any thereof can be attached directly to at least one of the shield 110, including near the edge of the shield 110, and/or the base plate 130 by, for example, adhesive, sewing, tying, crimping, ultrasonic welding, one or more fasteners, for example bolts, screws, rivets, or some other means. In another embodiment, features, for example slots, can be cut out of the shield 110, including near the edge of the shield 110, and/or the base plate 130, to receive the strap(s) 150, webbing(s) or fabric, in the manner of an integral buckle. In still further embodiments, rigid members made out of, for example, metal, plastic or a composite material, can be substituted for each strap 150, webbing or fabric, which will hereinafter be referred to as support arms. The support arms can be fixably attached to at least one of the shield 110, including near the edge of the shield 110, and/or the base plate 130 by, for example, fasteners, for example bolts, screws, rivets, or some other means. In certain embodiments, the support arms may be integral to the base plate 130. In these embodiments, the base plate 130 and support arms can act as one support structure fixably attached near at least one edge of the shield 110.

In certain embodiments including edge spring clips 162, straps 150 and base plate clips, where the straps 150 are taught, the force holding up the shield 110 may be transmitted from accessories attached to the base plate 130, through the base plate clips, through the straps 150 to the edge spring clips 162. In these embodiments, the straps 150 that are taught act as rigid members, allowing them to accept and transmit the upward force from the base plate 130 and transfer the force to the shield 110. The force acting through the straps 150 may be combined with the spring tension acting perpendicular to the base plate assembly (as defined below), forcing the base plate assembly to remain firmly affixed against the safe face of the shield.

Figure 10:
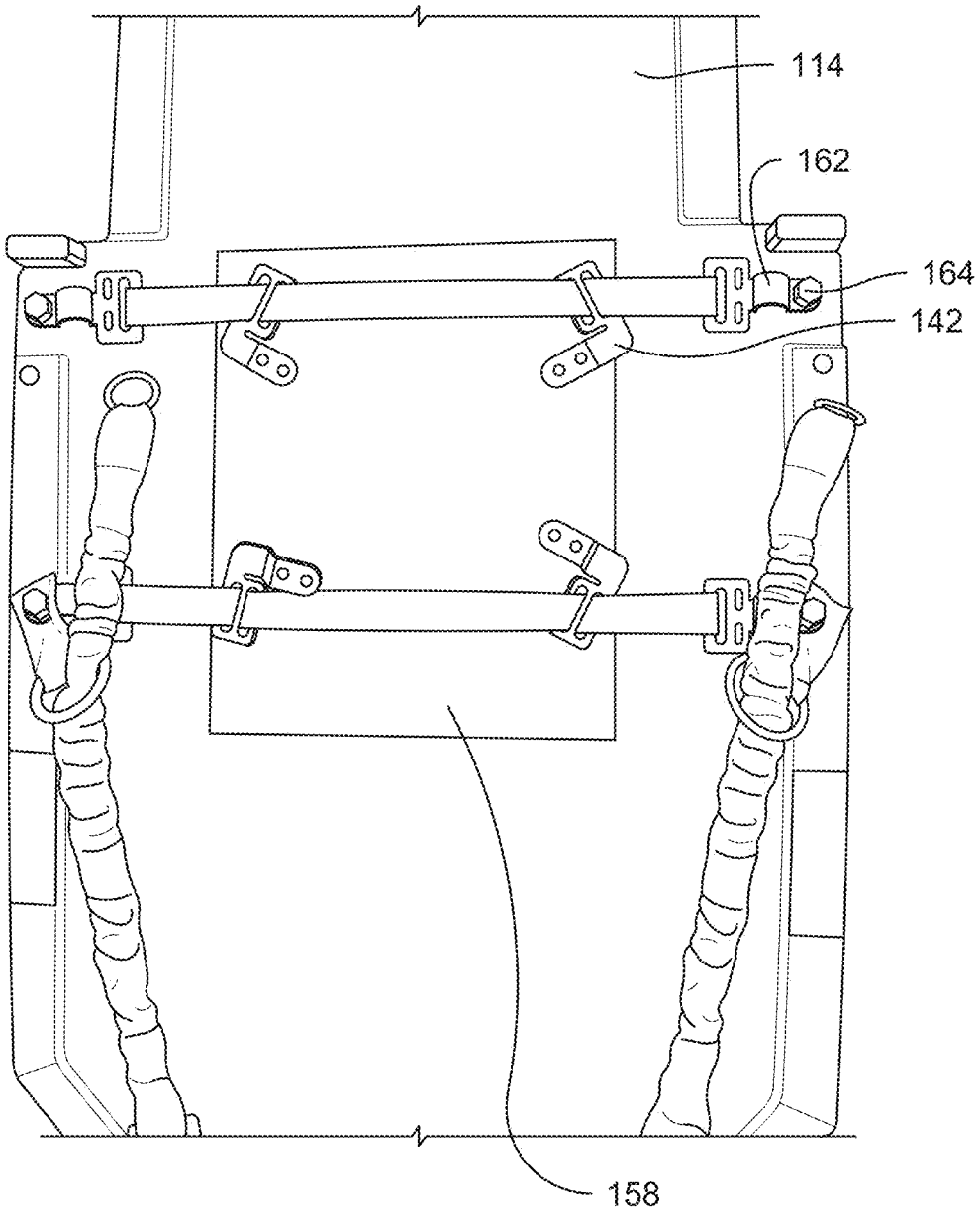
FIG. 10 is a rear view of at least a portion of a ballistic shield system according to one embodiment of the present disclosure.
Figure 11:
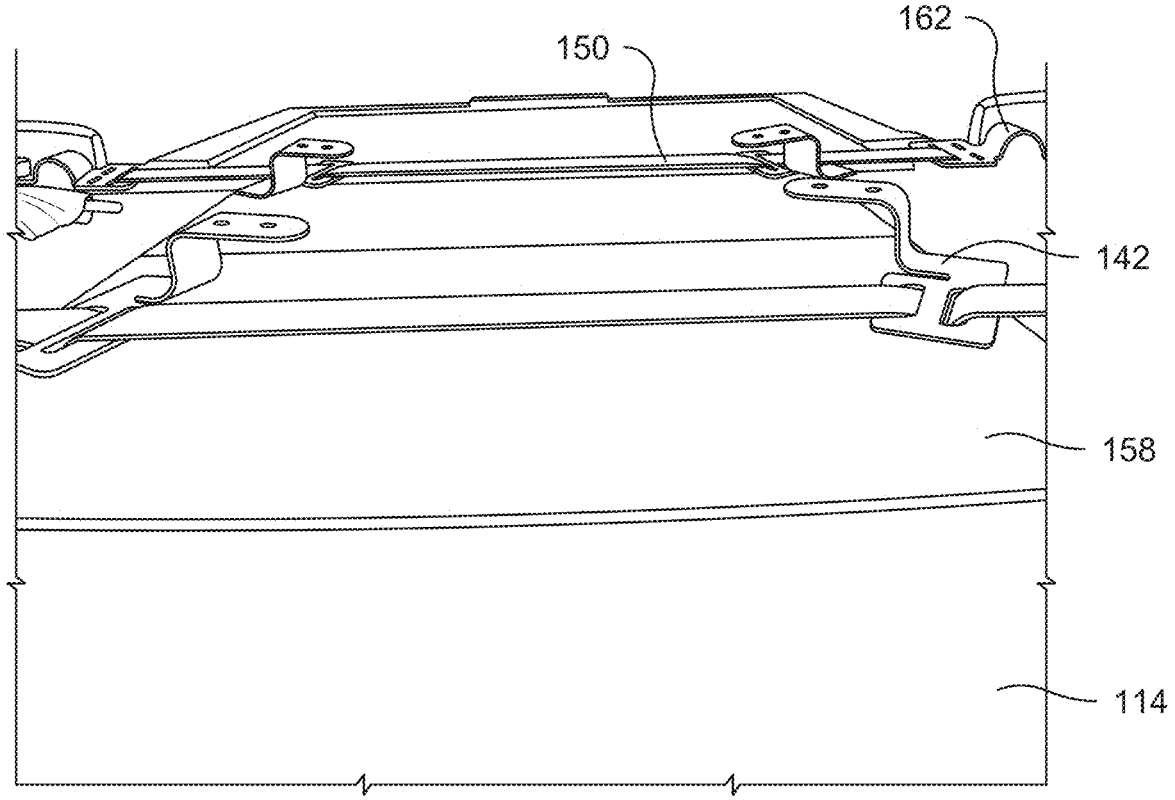
FIG. 11 is a magnified perspective view of a portion of the system shown in FIG. 10.
Figure 12:
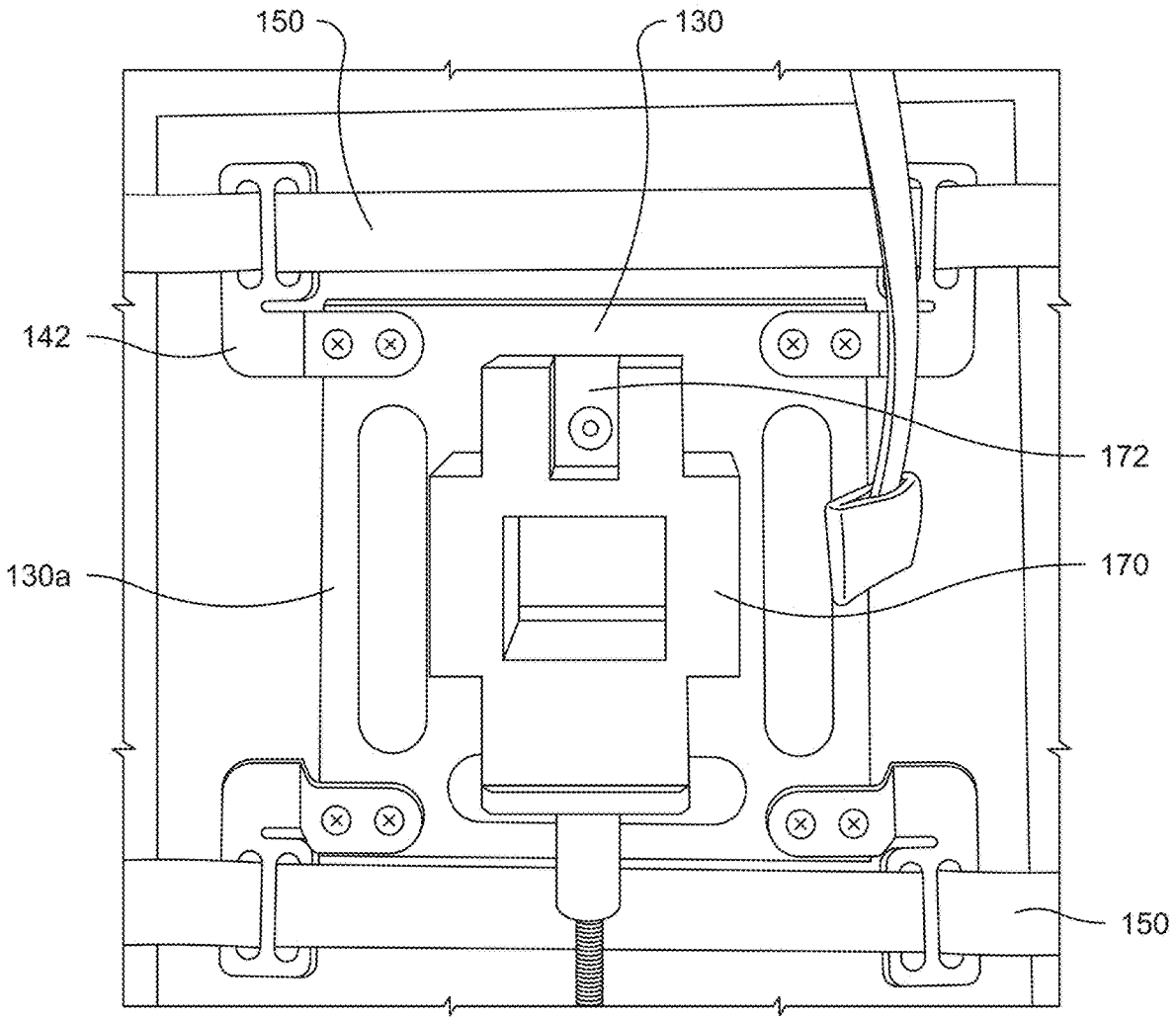
FIG. 12 is a magnified view of a portion of a ballistic shield system according to one embodiment of the present disclosure.

Referring to FIG. 10, in certain embodiments, at least a portion of at least one of the safe face 114 of the ballistic shield 110 and the shield side **130*b* of the base plate 130 can include a textured surface 158. In some embodiments, both the safe face 114 of the ballistic shield 110 and the shield side 130*b* of the base plate 130 can include a textured surface 158. In either embodiment, in conjunction with the spring tension on the base plate 130, the friction of the textured surface can impede the base plate 130 from sliding relative to the ballistic shield 110. The textured surface 158 can be integral to the material of the safe face 114 of the ballistic shield 110 or the shield side 130*b* of the base plate 130, made for example by a mold, sanding, sand blasting, or other techniques. In other embodiments, the textured surface 158 can created by applying a textured layer to at least one of the safe face 114 of the ballistic shield 110 or the shield side 130*b* of the base plate 130**.

Figure 13:
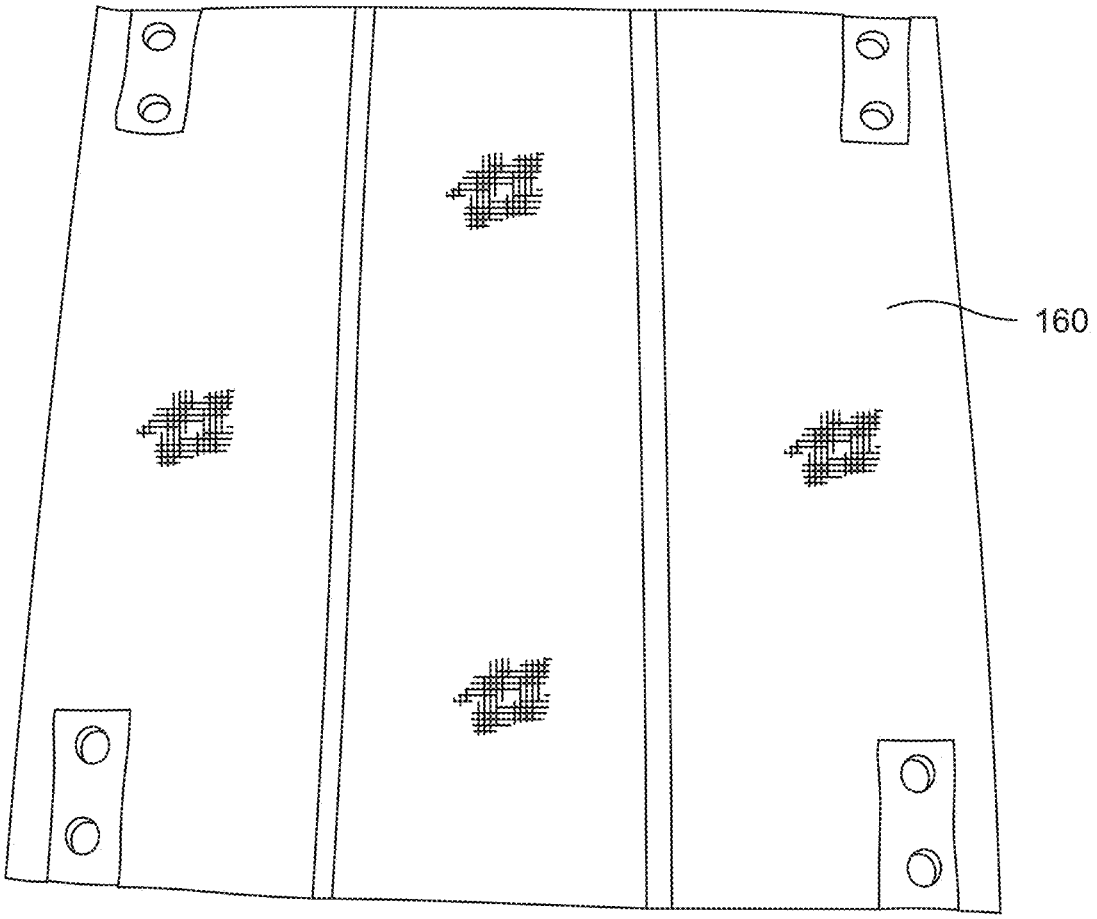
FIG. 13 is a magnified view of a portion of a ballistic shield system according to one embodiment of the present disclosure.
Figure 14B:
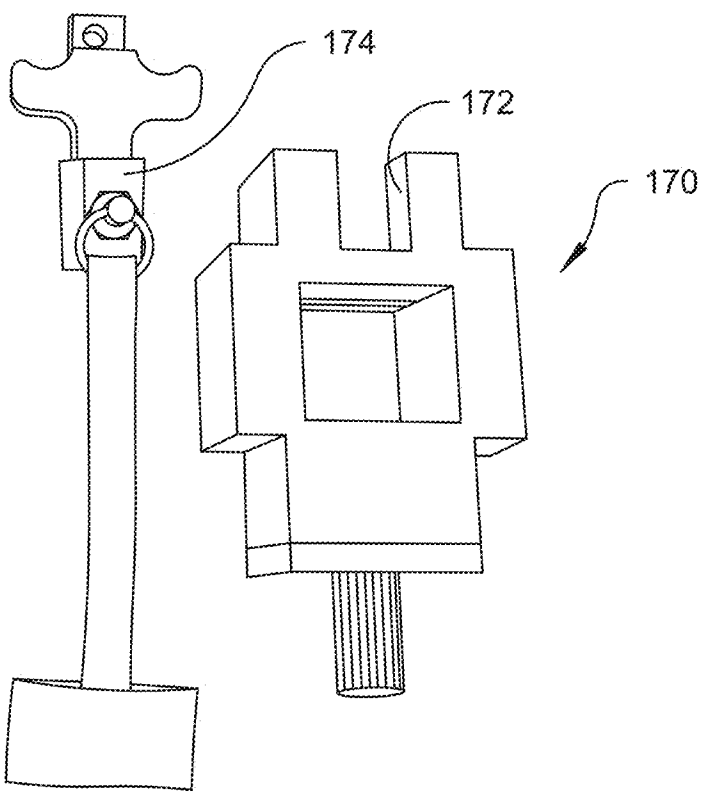
FIG. 14B is a partially exploded view of the device shown in FIG. 14A.
Figure 14A:
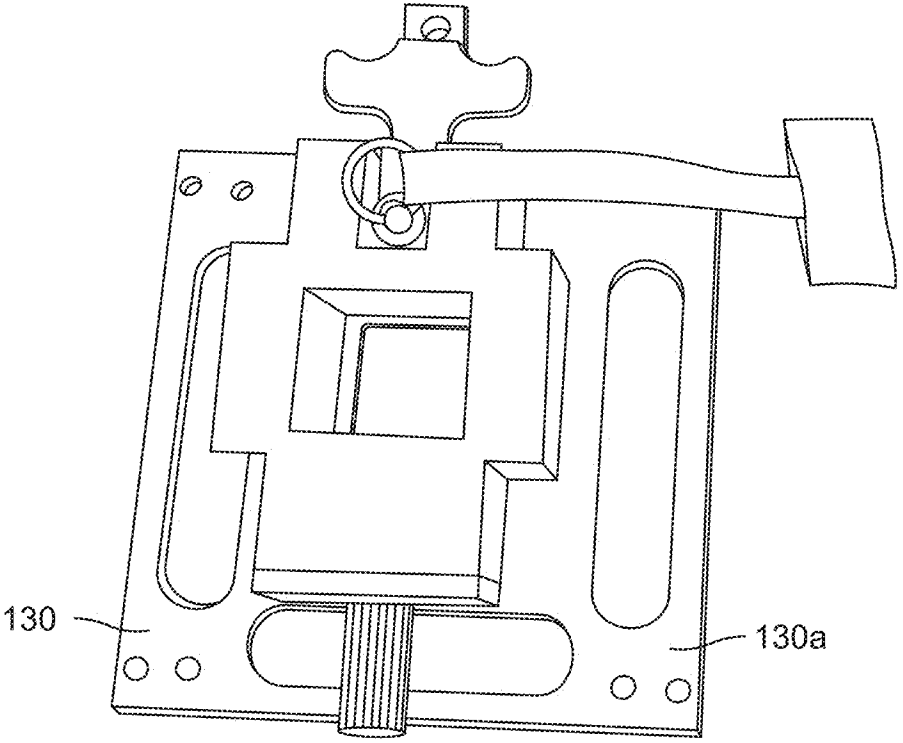
FIG. 14A is a perspective view of a portion of the system of one embodiment of the present disclosure.
Figure 15:
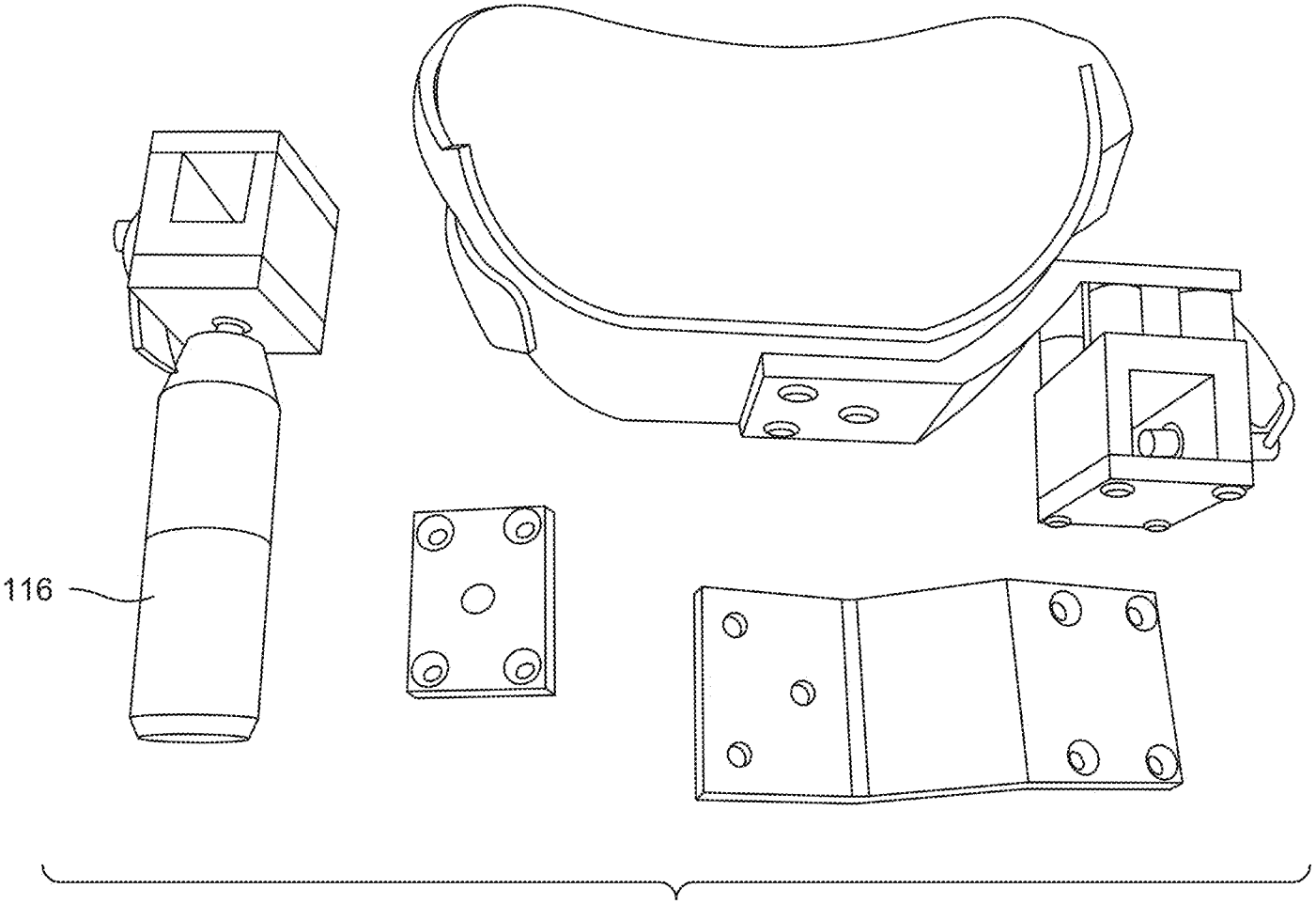
FIG. 15 is an exploded view of certain components of the system.

Referring to FIG. 13, other embodiments of the presently disclosed technology can include an intermediate adhering layer 160 between the safe face 114 of the ballistic shield 110 and the shield side **130*b* of the base plate 130. The intermediate adhering layer 160, in conjunction with the spring tension on the base plate 130, can impede the base plate 130 from sliding or otherwise moving relative to the ballistic shield 110, and can also adhere or generally fix the base plate 130 to the ballistic shield 110. In some embodiments, the adhesive strength of the intermediate adhering layer allows the base plate 130 to become temporarily spaced-apart or detached from the ballistic shield 110, at least momentarily, when a projectile strikes the strike face 112 of the ballistic shield 110. In other embodiments, the spring tension on the base plate 130 forces the base plate 130 back into contact with the ballistic shield 110, and once again the intermediate adhering layer 160 adheres the base plate 130 to the ballistic shield 110. In certain embodiments, the intermediate adhering layer 160** is selected from the group consisting of a textured layer, an adhesive, hook and loop material (for example, Velcro®), and combinations of any thereof.

Some embodiments of the presently disclosed invention include at least one crushable layer 132 in between the safe face 114 of the ballistic shield 110 and the shield side **130*b* of the base plate 130. The crushable layer 132 can be formed of crushable materials that in some embodiments do not inhibit the rearward motion of the ballistic shield 110 and/or the projectile, and can prevent subsequent loss of armor performance or protection. In other embodiments, the crushable layer 132 does not inhibit delamination and/or deformation of the composite armor material of the safe face 114 of the ballistic shield 110, and can prevent subsequent loss of armor performance. In further embodiments, the crushable layer 132 crushes or compresses when a projectile strikes the ballistic shield 110, which can further absorb energy from the projectile, reducing the transfer of energy, damage and movement to the base plate 130 and its accessories. In still further embodiments, the crushable material of the crushable layer 132 cushions the person or thing holding the shield and the shield accessories, which may reduce or eliminate impact damage, blunt trauma, destabilization or detachment of the person, thing or accessories from the ballistic shield 110**.

The crushable material may include, for example, foam, honeycomb, an epoxy material, a woven material, a plastic material, and any other material that offers structural rigidity, yet readily deforms under the force of the armor safe face moving rearward during ballistic impact. In further embodiments, the crushable material possesses an adequate level of structural strength following damage caused by a projectile striking the strike face 112 of the shield 110 adjacent to the base plate 130 and crushable layer 132. In some embodiments, the crushable layer 132 may be from approximately 0.25 inches thick to 6 inches thick, from approximately 2 inches thick 5 inches thick, and in still further embodiments, the crushable layer may be approximately 5 inches thick. In certain embodiments where the projectile threat to the ballistic shield 110 is a center-fire rifle projectile, the thickness of the crushable material 132 may be from 0.5 inches to 2 inches thick.

Figure 8:
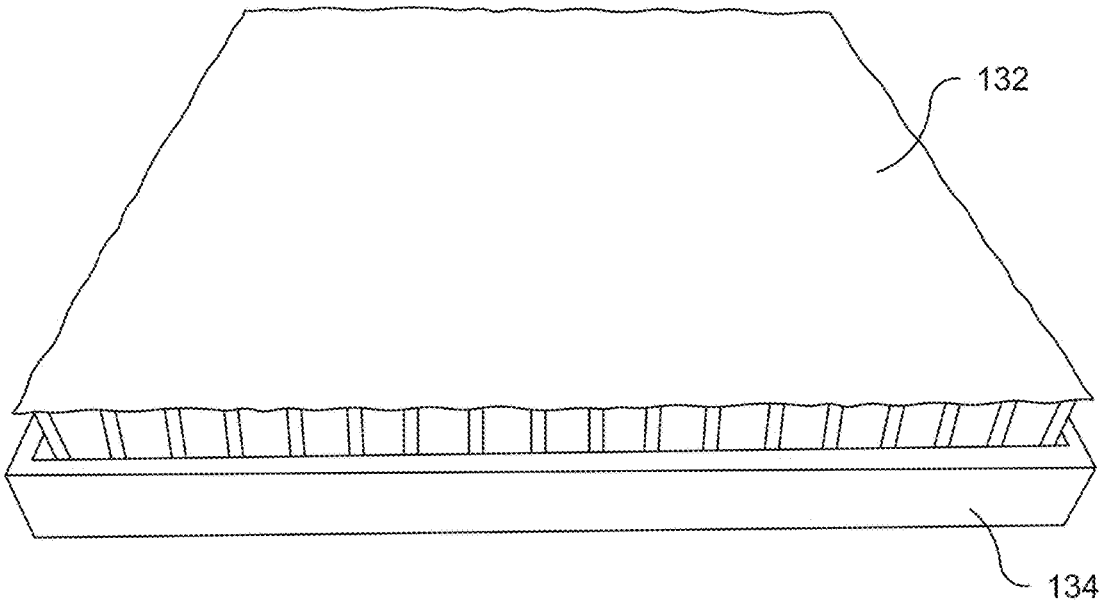
FIG. 8 is a perspective view of the portion of the system shown in FIG. 7, wherein certain features are omitted for clarity.
Figure 9:
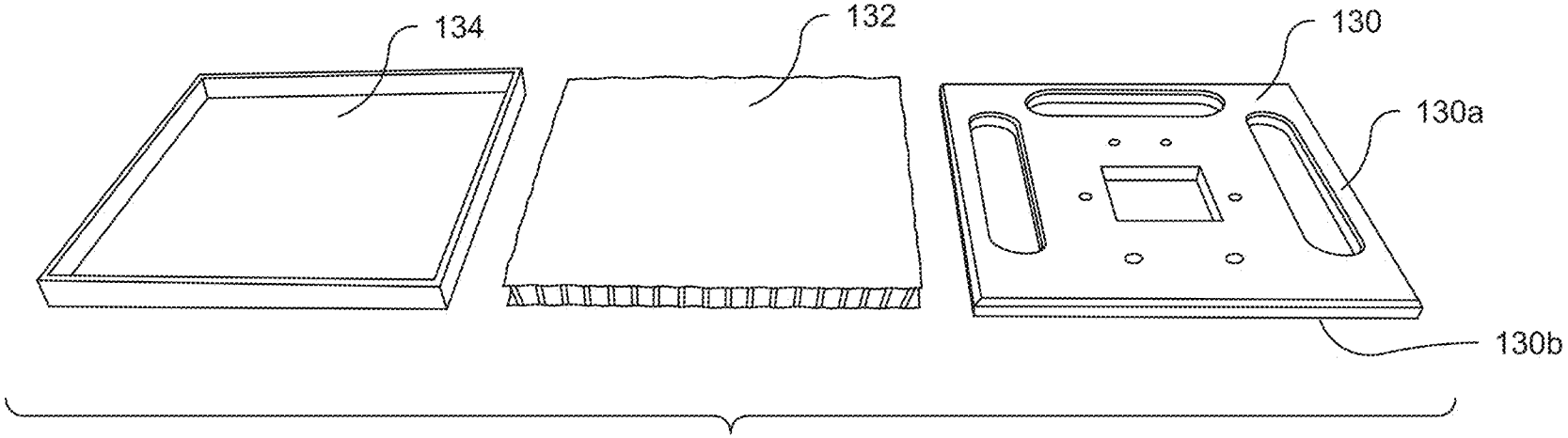
FIG. 9 is a perspective view of portions of the system shown in FIG. 7.

Certain embodiments include at least one retaining layer 134 in between the base plate 130 and the safe face 114 of the ballistic shield 110. In some embodiments, the retaining layer 134 is between the safe face 114 of the ballistic shield 110 and the crushable layer 132. In further embodiments, the retaining layer 134 has a bottom face and four sides, like a box with no lid (see FIGS. 8 and 9). The bottom face of the retaining layer 134 can include an inside face and an outside face. In still further embodiments, one of the crushable layer 132 or base plate 130 is seated at least partially within the four sides of the retaining layer 134 on the inside face of the bottom face. In some embodiments, at least a portion of both the crushable layer 132 and the base plate 130 are seated at least partially within the four sides of the retaining layer 134, with the crushable layer 132 being between the retaining layer 134 and the base plate 130 and a top surface of the crushable layer 132 being generally level with a top edge of the retaining layer 134. In other embodiments, only the crushable layer 132 is seated at least partially within the four sides of the retaining layer 134 on the inside face of the bottom face.

In certain embodiments, the four sides of the retaining layer 134 can inhibit or prevent movement of the crushable layer 132 and/or base plate 130 with respect to the retaining layer 134 and ballistic shield 110. In these embodiments, the outside face of the bottom face of the retaining layer 134 functions as the shield side 130*b* of the base plate 130 as described above, interfacing directly with the safe side 114 of the ballistic shield 110. In these embodiments, the outside face of the bottom face of the retaining layer 134 can include a textured surface as discussed herein, or may contact the adhering layer as discussed herein. In certain embodiments, the combination of a base plate 130, retaining layer 134, crushable layer 132, and any textured surface and/or adhering layer may be collectively referred to herein as a "base plate assembly". The components of the base plate assembly, in at least one embodiment, can be secured to each other with a plurality (e.g., four) of fasteners (not shown) located near outer corners thereof and/or with adhesive.

Mounting or carrying hardware, including handles, quick-releases, etc., can be fastened, such as by one or more screws, bolts, or otherwise, directly and/or only to the base plate 130. Any fasteners used for this purpose can be thinner, narrower and/or smaller than other fasteners used in the system. Such smaller fasteners can be configured to bend and/or break prior to transferring any significant force to the base plate 130. In addition, at least the sidewalls of the retaining layer 134 can be configured to at least partially crush or crumble when subjected to a significant force (e.g., the force of a projectile) so as to reduce the force transferred to the base plate 130 on impact of a projectile while allowing the armor panel to move rearwards without restriction.

Referring to FIGS. 5, 6, 12, 14A and 14B, in some embodiments, the system can include an adapter 170 that can either be fixedly or removably attached to at least a portion of the base plate 130, for example. The adapter 170 can be configured to attach one or more accessories, such as one or more of the base plate accessories, to the base plate 130. A slot or groove 172 of the adapter 170 can be sized, shaped and/or configured to receive at least a portion of a quick-release pin 174.

Figure 19:
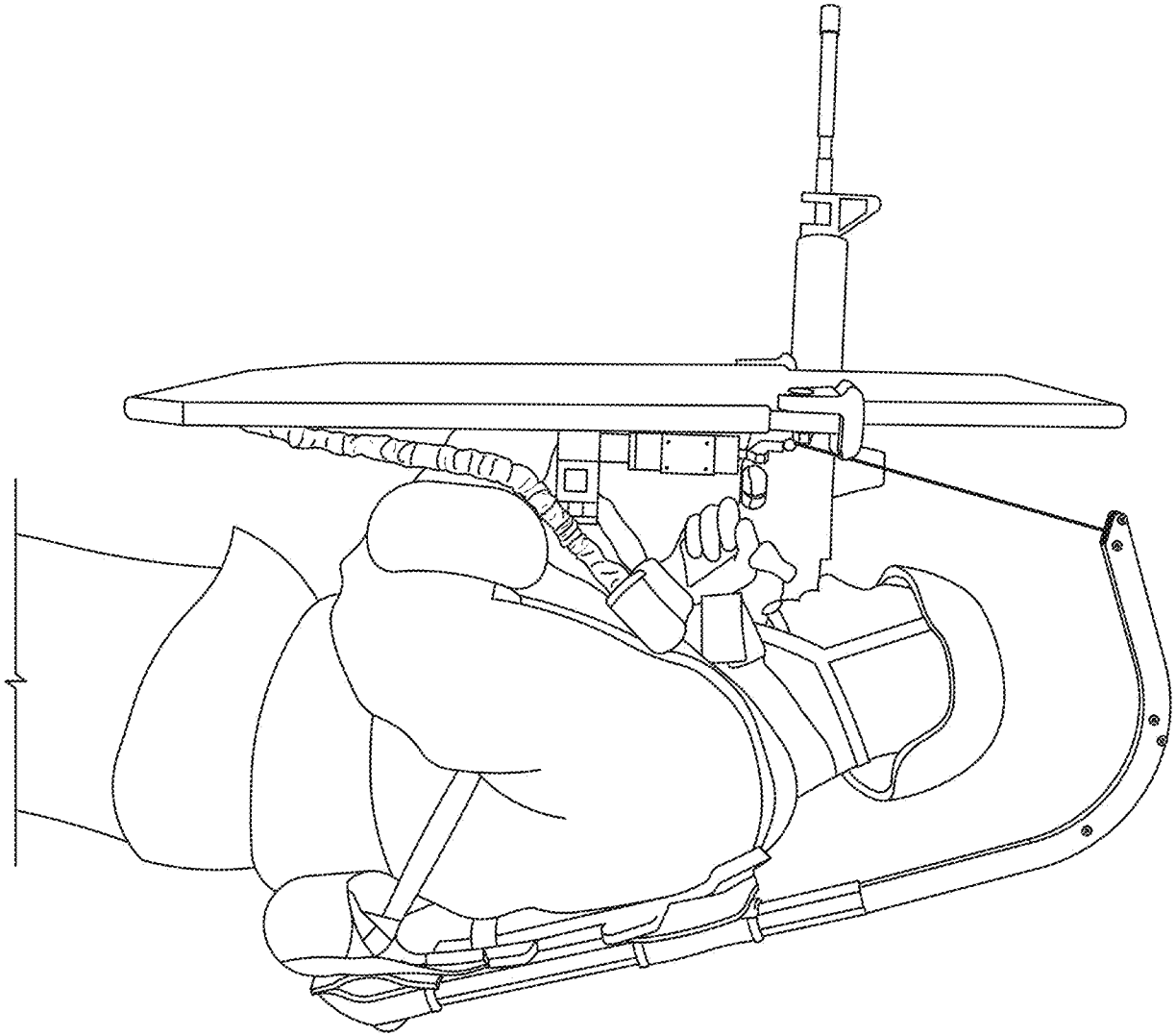
FIG. 19 is a side view of a suspension system according to one embodiment of the present disclosure.

Referring to FIG. 19, the shield can be at least partially suspended by a suspension system. In certain embodiments, the suspension system can attach to the base plate 130 or base plate assembly. In other embodiments such as the one shown in FIG. 19, the suspension system can attach to an adapter 170. In any of these embodiments, the suspension system may attach by a fastener, e.g. a bolt, or a quick-release mechanism. In some embodiments, a forward portion of the suspension system may include a cable or other moveable load-bearing member suspended from an overhead support. The overhead support can attach to the person carrying the shield 110. In some embodiments, the overhead support attaches to a backpack or other mounting system worn by the person. The suspension system may include other features such as a shock absorption device, for example a piston, or some other hydraulic, pneumatic, or mechanical device. The suspension system can reduce the amount of force required by the person's arms to hold up the shield 110.

In still further embodiments, the suspension system may include other straps that attach either to the base plate 130 or base plate assembly, or to the safe face 114 of the shield 110 itself. These straps may also attach to the overhead support, or as in FIG. 19, may attach to the shoulder straps of the backpack or other mounting system worn by the person. These additional straps may also reduce the amount of force required by the person's arms to hold up the shield 110, and may also help to control the shield 110, for example to prevent or reduce the shield from rotating on the cable.

EXAMPLES

Example 1

In one example, a composite ballistic shield was tested. The composite armor sample target used in this test was made out of 85 layers of soft pliable polyethylene film, formed under extreme pressure and heat into a rigid composite armor panel. This panel measures 17 mm thick and is rated to meet the National Institute of Justice (NIJ) ballistic performance standard NIJ STD 0108.01 for Threat Level Type III performance NIJ STD 0108.01 Level III rifle testing protocol specifies five impacts of 7.62 mm×51 mm NATO lead core full metal jacketed projectiles that all must be stopped at distances greater than 2" from the armor's edges at velocities between 2700 to 2800 feet per second, in a pre-determined five impact pattern.

Figure 3:
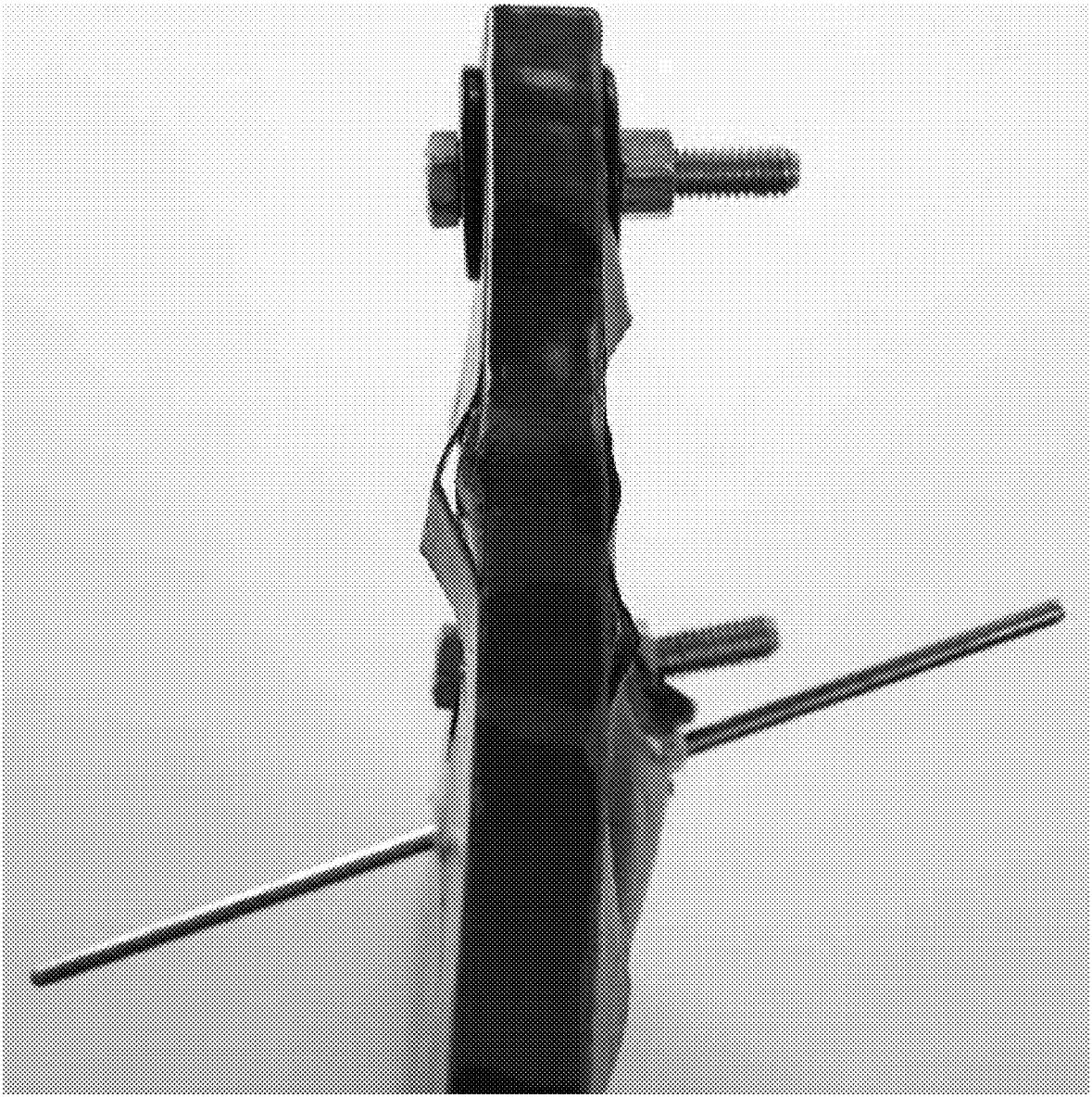
Fig. 3 (Prior Art)
FIG. 3 is a side view of the shield of FIG. 1, wherein a shaft is shown through a hole made in the shield by a projectile that was shot through the shield.

An 8 mm diameter hole was drilled in the shield approximately 3.25 inches from the edge of the armor, which is in the area that must stop the specified projectile in order to pass the test. Into the hole was inserted an 8 mm diameter grade 8 hex-bolt, with a metal washer on either side of the shield as shown in FIG. 3.

Figure 4:
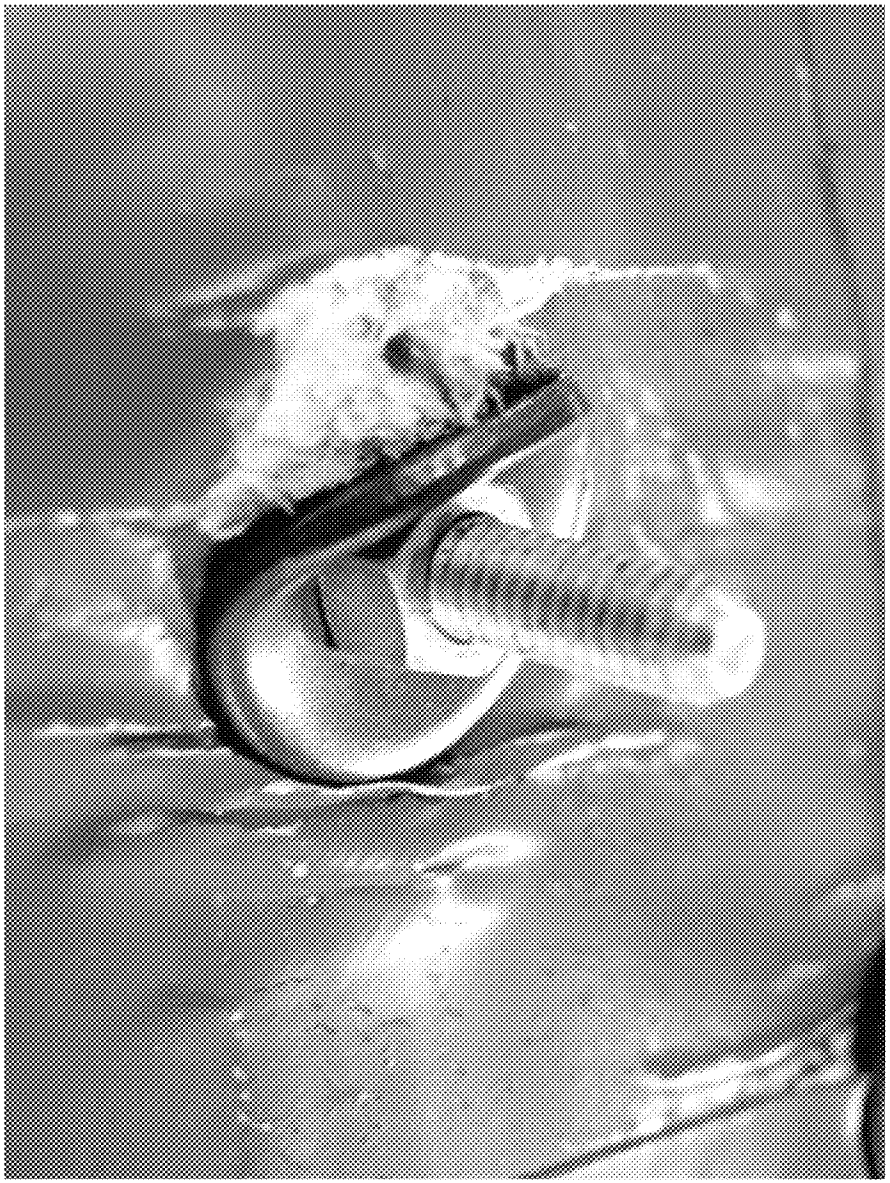
Fig. 4 (Prior Art)
FIG. 4 is a magnified view of a portion of the shield of FIG. 1 where the projectile was shot through the shield.

A 7.62 mm×51 mm NATO lead core was fired at the strike face of the shield within an inch of the bolt at a velocity of 2,689 fps, which is slightly slower than the test standard. The projectile traversed the entire thickness of the shield. The hole is shown in FIG. 4. This is evidenced in FIGS. 3-4, which show a steel rod inserted through the hole made by the projectile and protruding on both sides of the shield.

At the location that the projectile struck the shield, the shield would have been expected to stop the projectile, however, because of the proximity of the bolt and bolt hole, the shield failed to capture the projectile.

Example 2

In one example, a composite ballistic shield was tested. A sample portion of a shield was made out of 85 layers of soft pliable polyethylene film formed under extreme pressure and heat into a rigid composite armor panel. This panel measures 17 mm thick and is rated to meet the National Institute of Justice (NIJ) ballistic performance standard NIJ STD 0108.08 for Threat Level Type III performance Level III rifle testing specifies five impacts of 7.62 mm×51 mm NATO lead core full metal jacketed projectiles that all must be stopped at distances greater than 2" from the armor's edges at velocities between 2700 to 2800 feet per second, in a pre-determined five impact pattern.

Figure 20:
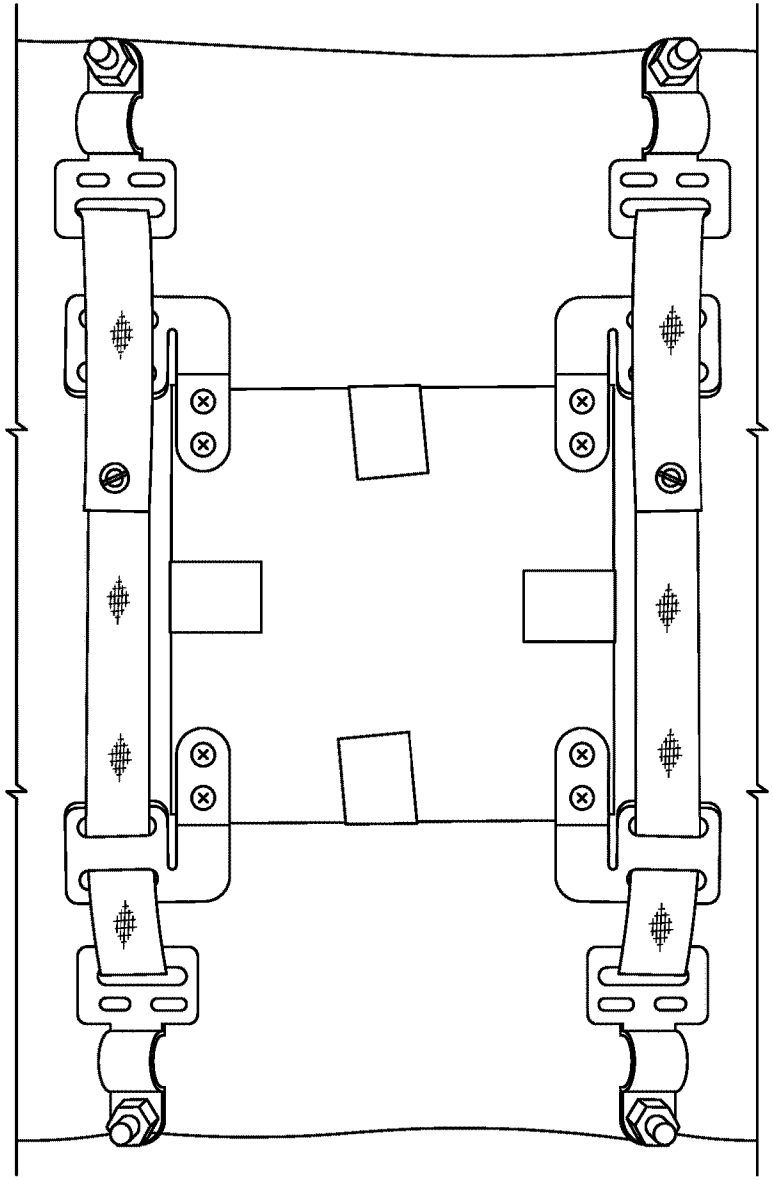
FIG. 20 is a magnified view of a portion of a ballistic shield system according to one embodiment of the present disclosure.

The sample portion of the shield was 16 inches long and 16 inches wide. Four holes were drilled approximately ½ inch form the edge as shown in FIG. 20. On the safe side of the sample, one spring clip was secured in each hole by a bolt. A retaining layer was centered on the sample and fastened to the safe face of the armor by Velcro® hook and loop fasteners. The retaining layer was made out of molded ABS plastic sheet, ⅛ inch thick, 9/16 inches tall and 8.5 inches square.

On top of the retaining layer was placed a crushable layer made out of plastic honeycomb surfaced with fiberglass matting and epoxy material, measuring ½" thick, and 8 inches square On top of the crushable layer was placed a base plate made out of made out of aluminum sheet, measuring ⅛ inches high, and 8.5" square.

Figure 21:
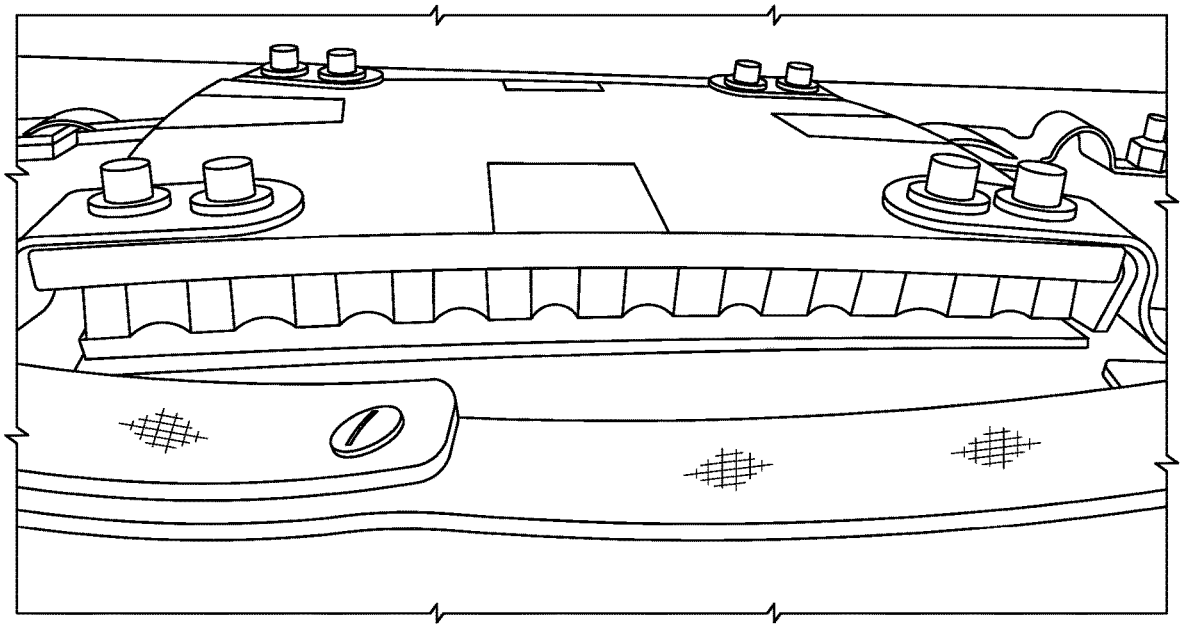
FIG. 21 is a magnified perspective view of a portion of the system shown in FIG. 20.

Two holes were drilled near each corner of the base plate as shown in FIG. 20. Four base plate clips were placed on top of the four hole patterns on each corner and secured with 3/16 inch diameter bolts. Kevlar® para-aramid straps were woven through the spring clips and base plate clips as shown in FIG. 20 and stretched taught. A cross-section of the setup is shown in FIG. 21.

Figure 22:
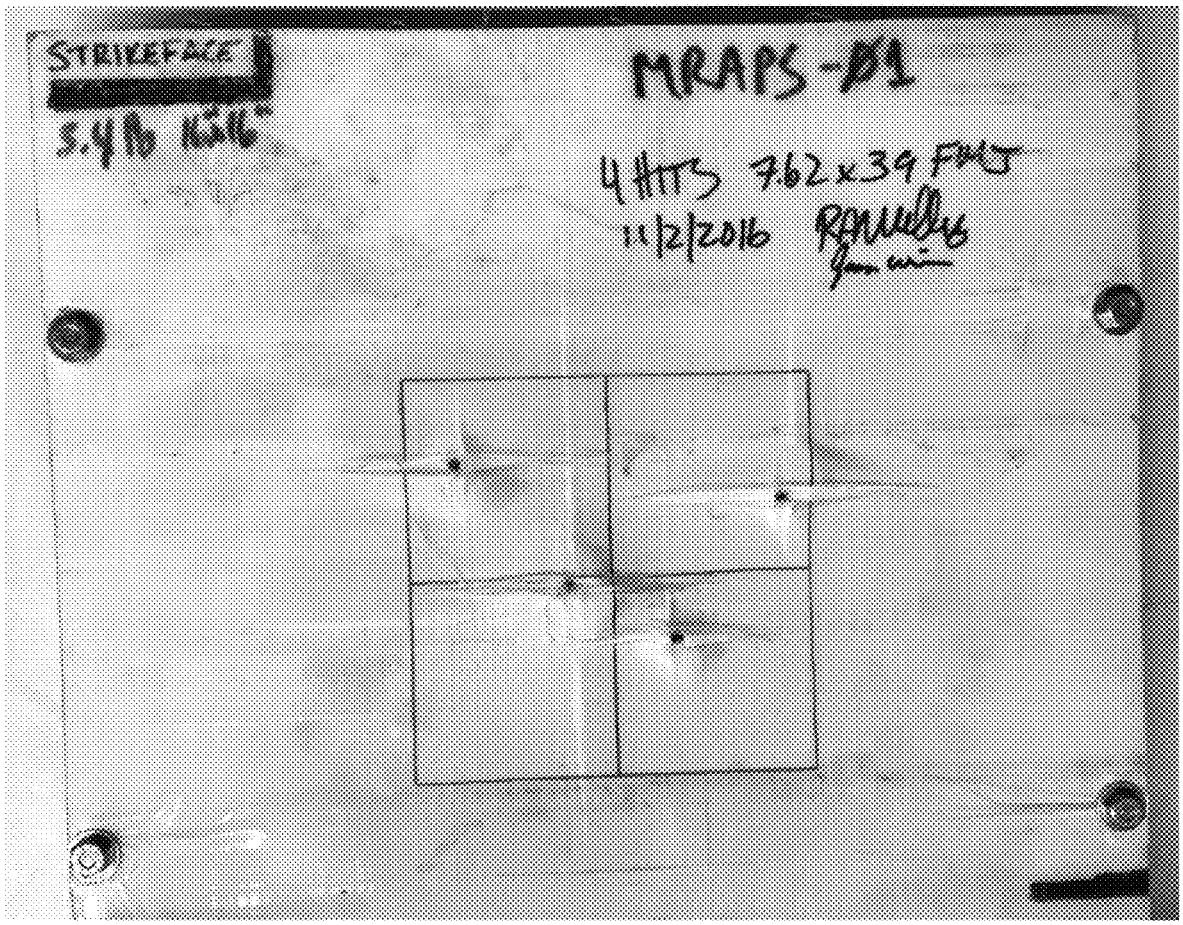
FIG. 22 is a view of a piece of a ballistic shield that has been impacted by projectiles as described in Example 2.
Figure 23:
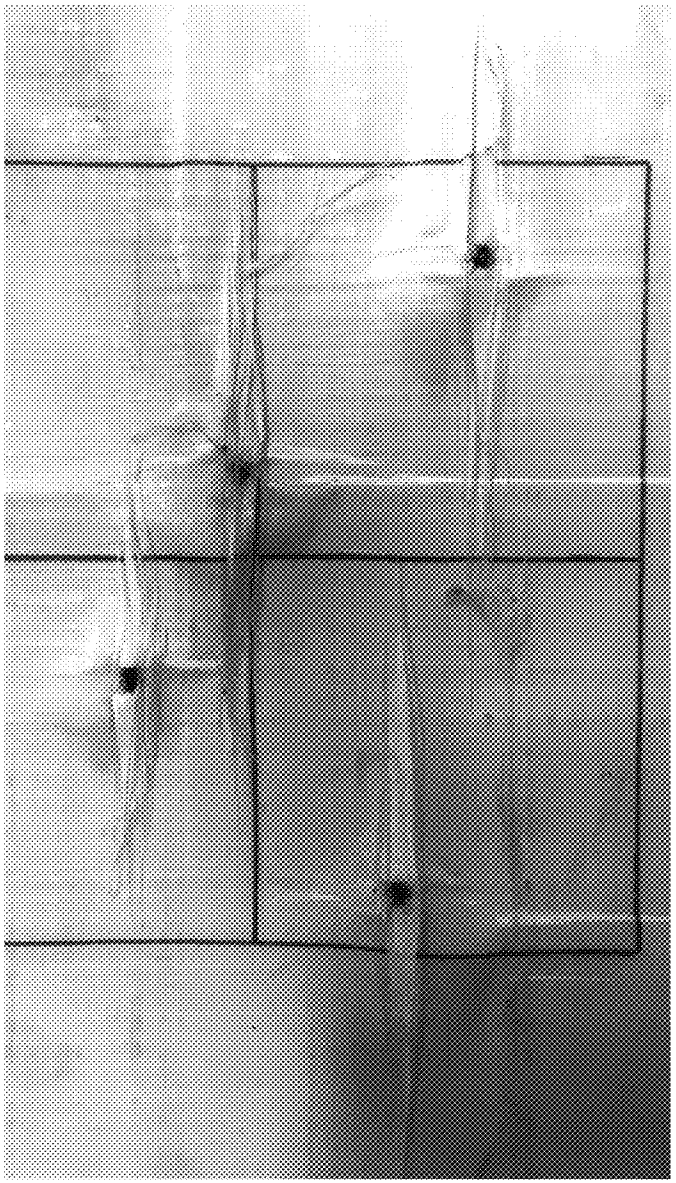
FIG. 23 is a view of a piece of a ballistic shield that has been impacted by projectiles as described in Example 2.

Four projectiles, 7.62 mm×39 mm 123 grain Full Metal Jacket fired from an AK-47 weapon were fired at the strike face of the sample within the outline of the base plate on the other side of the sample adjacent to the safe face. The speed of the projectiles was 2315, 2298, 2331, 2326 fps. The entry holes for the four projectiles can be seen in FIGS. 22 and 23. FIGS. 22 and 23 photographs taken after the test. None of the projectiles traversed the thickness of the shield sample. The sample captured all four projectiles. The baseplate, spring clips, and straps were all intact after the test. There was minimal (almost nonexistent) back-face signature deformations recorded on NIJ Standard approved conditioned Roma Plastilina clay medium (less than 0.25 inch indentations measured for each projectile).

I claim:

1. A system comprising:

a ballistic shield having a strike face and an opposing safe face, a thickness of the ballistic shield extending from the strike face to the safe face, a first edge, a second edge, and a width extending between the first edge and the second edge in a first direction, a base plate having a shield side and an opposing body side, the base plate being connected to the ballistic shield, a crushable layer disposed in between the safe face of the ballistic shield and the shield side of the base plate, the crushable layer being configured to reduce the transfer of energy between the ballistic shield and the base plate, a strap extending in the first direction from a first end of the strap to a second end of the strap, and having the first end attached to the safe face of the ballistic shield proximate the first edge of the ballistic shield, and having the second end attached to the safe face of the ballistic shield proximate the second edge of the ballistic shield, and the strap being configured to retain the base plate and apply a force to the body side of the base plate to maintain the base plate relative to the ballistic shield, the strap being further configured to support a weight of the ballistic shield via the base plate.

2. The system of claim 1, wherein the each of the first end and the second end of the strap is attached to the safe face of the ballistic shield by at least one clip, each clip further including a fastener that traverses the thickness of the ballistic shield.

3. The system of claim 1, further comprising:

at least one base plate spring clip mounted to the base plate, wherein the strap is configured to contact the at least one base plate spring clip.

4. The system of claim 1, wherein at least a portion of at least one of the safe face of the ballistic shield and the shield side of the base plate is textured.

5. The system of claim 1, further comprising:

an intermediate adhering layer between the safe face of the ballistic shield and the shield side of the base plate.

6. The system of claim 5, wherein the intermediate adhering layer is selected from the group consisting of a textured layer, an adhesive, hook and loop material, and combinations of any thereof.

7. The system of claim 1, further comprising:

a retaining layer disposed in between the crushable layer and the safe face of the ballistic shield.

8. The system of claim 1, wherein the base plate is formed of a different material than the ballistic shield.

9. The system of claim 1, wherein the base plate is configured to support at least one ballistic shield accessory.

10. The system of claim 9, wherein the at least one ballistic shield accessory is a handle configured to support the ballistic shield.

11. The system of claim 1, wherein the first edge of the strap is attached to the safe face of the ballistic shield within three inches of the first edge of the ballistic shield, and wherein the second end of the strap is attached to the safe face of the ballistic shield within three inches of the second edge of the ballistic shield.

* * * * *